US009694388B2

(12) United States Patent
Curran et al.

(10) Patent No.: US 9,694,388 B2
(45) Date of Patent: Jul. 4, 2017

(54) WATERPROOF COATING WITH NANOSCOPIC/MICROSCOPIC FEATURES AND METHODS OF MAKING SAME

(71) Applicants: Seamus Curran, Pearland, TX (US); Kang-Shyang Liao, Houston, TX (US); Nigel Alley, Houston, TX (US); Amrita Haldar, Houston, TX (US); Alexander Wang, Houston, TX (US); Renat Tatarin, Houston, TX (US)

(72) Inventors: Seamus Curran, Pearland, TX (US); Kang-Shyang Liao, Houston, TX (US); Nigel Alley, Houston, TX (US); Amrita Haldar, Houston, TX (US); Alexander Wang, Houston, TX (US); Renat Tatarin, Houston, TX (US)

(73) Assignee: UNIVERSITY OF HOUSTON SYSTEM, Houston, TX (US)

( * ) Notice: Subject to any disclaimer, the term of this patent is extended or adjusted under 35 U.S.C. 154(b) by 0 days.

(21) Appl. No.: 14/277,325

(22) Filed: May 14, 2014

(65) Prior Publication Data

US 2014/0342098 A1 Nov. 20, 2014

Related U.S. Application Data

(60) Provisional application No. 61/823,127, filed on May 14, 2013, provisional application No. 61/946,169, filed on Feb. 28, 2014.

(51) Int. Cl.

| | |
|---|---|
| ***B05D 5/08*** | (2006.01) |
| ***B05D 1/18*** | (2006.01) |
| ***D06M 23/00*** | (2006.01) |

(52) U.S. Cl.

CPC ..... *B05D 5/083* (2013.01); *B05D 1/185* (2013.01); *D06M 23/00* (2013.01); *B05D 2350/60* (2013.01)

(58) Field of Classification Search

CPC ..... B05D 5/083

See application file for complete search history.

(56) References Cited

U.S. PATENT DOCUMENTS 4,661,400 A * 4/1987 Guglielmo, Sr. ..... A01K 75/00 106/15.05

5,328,768 A 7/1994 Goodwin (Continued)

FOREIGN PATENT DOCUMENTS

| | | | |
|---|---|---|---|
| WO | WO-03/015891 | A1 | 2/2003 |
| WO | WO-2009/118552 | A1 | 10/2009 |
| WO | WO-2013/019965 | A1 | 2/2013 |

OTHER PUBLICATIONS

Nakajima et al "Preparation of Hard Super-Hydrophobic Films with Visible Light Transmission" Thin Solid Films 376 (2000) 140-143.*

(Continued)

*Primary Examiner* — Nathan Empie

(74) *Attorney, Agent, or Firm* — Winstead PC

(57) ABSTRACT

A process of fabricating the waterproof coating may include selecting a substrate, utilizing a sol-gel comprising a silane or silane derivative and metal oxide precursor to coat the substrate, and optionally coating the substrate with a hydrophobic chemical agent and/or other chemical agents to create a surface with nanoscopic or microscopic features. The process may utilize an all solution process or controlled environment for fabricating self-cleaning and waterproof coating that prevent wetting or staining of a substrate, or may utilize a controlled environment.

20 Claims, 8 Drawing Sheets

(56) References Cited

U.S. PATENT DOCUMENTS

| | | | | |
|---|---|---|---|---|
| 5,424,130 | A | 6/1995 | Nakanishi et al. | |
| 5,523,161 | A | 6/1996 | Goodwin | |
| 5,626,994 | A * | 5/1997 | Takayanagi et al. | 430/7 |
| 5,853,896 | A | 12/1998 | Kondo et al. | |
| 6,048,580 | A * | 4/2000 | Carter et al. | 427/407.1 |
| 6,743,467 | B1 * | 6/2004 | Jones et al. | 427/180 |
| 7,138,186 | B2 | 11/2006 | Luten, III | |
| 7,635,522 | B2 | 12/2009 | Cnossen et al. | |
| 7,901,731 | B2 | 3/2011 | Russell et al. | |
| 2002/0010228 | A1 * | 1/2002 | Simendinger, III | 523/122 |
| 2004/0018301 | A1 | 1/2004 | Ackerman et al. | |
| 2006/0029808 | A1 | 2/2006 | Zhai et al. | |
| 2006/0113231 | A1 | 6/2006 | Malik | |
| 2006/0292345 | A1 | 12/2006 | Dave et al. | |
| 2008/0058489 | A1 | 3/2008 | Edelmann et al. | |
| 2008/0063859 | A1 | 3/2008 | Fath | |
| 2008/0113188 | A1 | 5/2008 | Shah et al. | |
| 2008/0176060 | A1 | 7/2008 | Harold et al. | |
| 2009/0011222 | A1 * | 1/2009 | Xiu et al. | 428/323 |
| 2009/0148711 | A1 | 6/2009 | Le Blanc et al. | |
| 2010/0034976 | A1 | 2/2010 | Fregonese et al. | |
| 2010/0112208 | A1 | 5/2010 | Malik et al. | |
| 2010/0203287 | A1 | 8/2010 | Jiang et al. | |
| 2010/0239824 | A1 | 9/2010 | Weitz et al. | |
| 2010/0249445 | A1 | 9/2010 | Yan et al. | |
| 2010/0255311 | A1 | 10/2010 | Lee et al. | |
| 2011/0159289 | A1 | 6/2011 | Blizzard | |
| 2011/0250422 | A1 | 10/2011 | Kessman et al. | |
| 2011/0250428 | A1 | 10/2011 | Leventis et al. | |
| 2012/0040179 | A1 | 2/2012 | Dave | |
| 2012/0141805 | A1 | 6/2012 | Wang et al. | |
| 2012/0156495 | A1 | 6/2012 | Auger | |
| 2012/0213935 | A1 | 8/2012 | Fregonese et al. | |
| 2013/0004137 | A1 | 1/2013 | Jin et al. | |
| 2013/0055927 | A1 | 3/2013 | Satoh et al. | |
| 2013/0095237 | A1 | 4/2013 | Kalyankar et al. | |
| 2013/0337226 | A1 | 12/2013 | Curran et al. | |

OTHER PUBLICATIONS

Roach et al "Progress in Superhydrophobic Surface Development" Soft Matter, 2008, 4, 224-240.*

Ishizaki et al "Corrosion Resistance and Durability of Superhydrophobic Surface Formed Magnesium Alloy Coated with Nanostructured Cerium Oxide Film and Fluoroalkylsilane Molecules in Corrosive NaCI Aqueous Solution" Langmuir 2011, 27, 4780-4788.*

Wang et al "Stable Highly Hydrophobic and Oleophilic meshes for Oil-water Separation" Applied Surface Science 253 (2007) 9054-9060.*

Hozumi et al "Fluoroalkylsilane Monolayers Formed by Chemical Vapor Surface Modification on Hydroxylated Oxide Surfaces" Langmuir 1999, 15, 7600-7604.*

Jaramillo et al "Towards an intrinsic nucleofugality scale: The leaving group (LG) ability in CH3LG model system" Chemical Physics Letters 420 (2006) 95-99.*

Zhang et al ("A transparent and photo-patternable superhydrophobic film" Chem. Commun. 2007, 4949-4951.*

Parkin, IP et al. "Self-cleaning coatings" J. Mater. Chern., vol. 15, Apr. 2005, pp. 1689-1695.

Liao, K-S., Wan, A., Batteas, J. D., Bergbreiter, D.E., "Superhydrophobic surfaces formed using layer-by-layer self-assembly with aminated multiwall carbon nanotubes" Langmuir 2008, 24, 4245-4253.

International Search Report and Written Opinion for PCT/US2014/037986 dated Sep. 18, 2014.

ESI for Zhang, X., et al., "A Transparent and Photo-Patternable Superhydrophobic Film", Chem. Commun., 2007, 4949-4951.

Furmidge, C.G. L., J. Colloid Sci. 1962, 17, 309-324.

* cited by examiner (a)

(b)

(c)

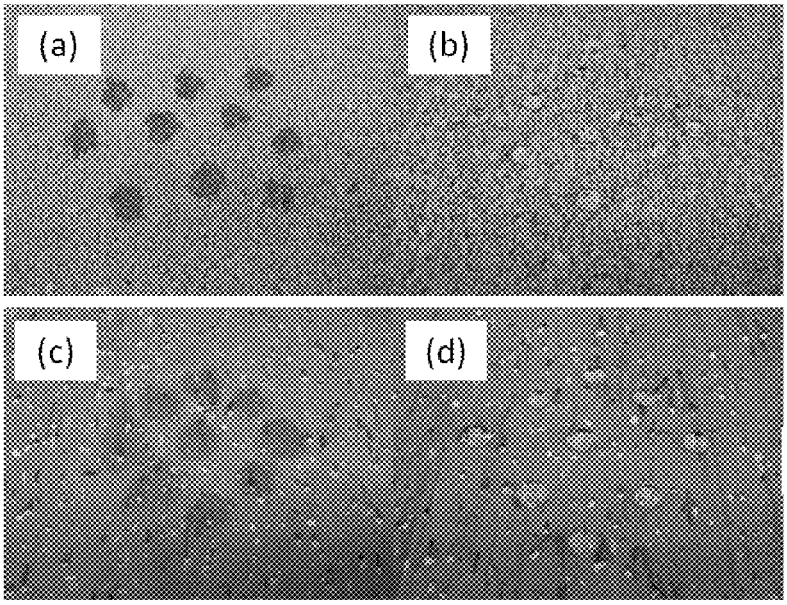
FIG. 9a
FIG. 9b
FIG. 9c
FIG. 9d
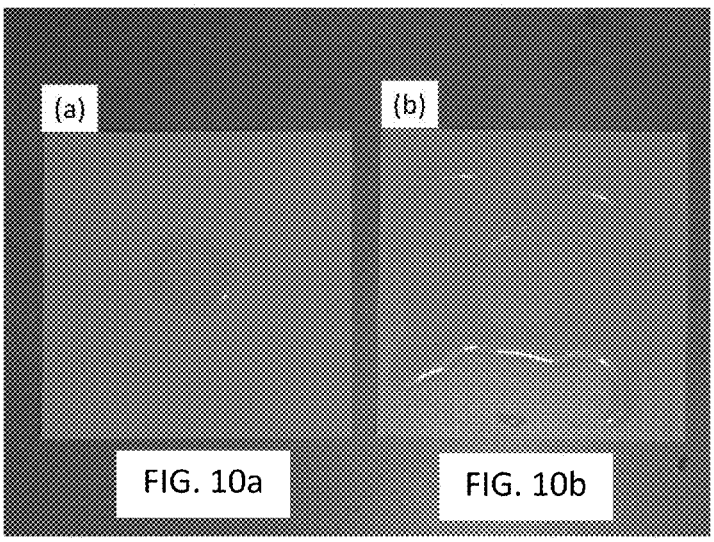
FIG. 10a
FIG. 10b

WATERPROOF COATING WITH NANOSCOPIC/MICROSCOPIC FEATURES AND METHODS OF MAKING SAME

RELATED APPLICATIONS

This application claims the benefit of U.S. Provisional Patent Application No. 61/823,127, filed on May 14, 2013, and 61/946,169, filed on Feb. 28, 2014, which are incorporated herein by reference.

STATEMENT REGARDING FEDERALLY SPONSORED RESEARCH

This invention was made with government support under Grant No. DD-N000141110069 from the Office of Naval Research at the US Department of Defense. The government has certain rights in the invention.

FIELD OF THE INVENTION

The present invention is directed to compositions and methods for making and using of waterproof coatings, including utilizing an all solution process or controlled environment.

BACKGROUND OF THE INVENTION

The wetting behavior of solid surfaces in contact with liquids is a very important area of research in surface chemistry. In recent years, hydrophobic/superhydrophobic surfaces that prevent water to "wet" the surface have attracted significant interest not only because of their potential applications but also because of a renewed interest in the fundamental understanding of wetting behavior that has been inspired by hydrophobic/superhydrophobic properties exhibited by living organisms observed in nature such as lotus leaves. Man-made (artificial) hydrophobic or superhydrophobic surfaces are most commonly fabricated in one of two general ways: they can either be produced by creating hierarchical micro/nanostructures on hydrophobic substrates or by chemically modifying a micro/nanostructured surface with molecules of low surface free energy. While various artificial superhydrophobic coatings using methods such as chemical vapor deposition, layer-by-layer assembly and micro-patterning have been reported, all of these methods require complicated manufacturing processes which are difficult to apply to large substrates.

FIG. 1*a* describes a general phenomenon where a water droplet slides down a tilted substrate surface of common materials such as glass or natural wood (that has no coating). Due to the strong surface tension between the substrate surface and water, the water droplet tends to break into small droplets and leaves a trail of smaller water droplets. The adhesion between the dust particles and the substrate surface also prevents the particles (depicted in black) from being washed away by the movement of a water droplet. By contrast, FIG. 1*b* describes a phenomenon where a water droplet slides down a tilted substrate surface that has been previously treated with a waterproof coating. Due to the greatly reduced surface tension between water and the coated substrate surface, the water droplet slides down without any remnant of the droplet adhering to the surface. The adhesion between the dust particles and the coated substrate surface is also reduced so the particles are washed away (depicted in black) by the movement of a water droplet.

To describe more accurately the above-mentioned phenomena that involve water sliding, it is important to first understand the physics of wetting and the sliding event of a liquid on a solid surface. When a drop moves on a surface, it has to both advance on the downhill side and recede on the uphill side as illustrated in FIG. 2*a*. The force required to begin the motion of the drop is a function described as eq. (1).

$$mg/w(\sin\alpha)=\gamma_{LV}(\cos\theta_R-\cos\theta_A) \quad (1)$$

where $\alpha$ is the critical angle for a given water droplet starts to moving down the substrate surface, m is the mass of the water droplet, g is the acceleration due to gravity, w is the width horizontal to the direction of drop movement, and $\theta_R$ and $\theta_A$ are the receding contact angle and the advancing contact angle of the water droplet on a substrate surface, respectively. The difference between advancing and receding contact angles is termed hysteresis. $\gamma_{LV}$ is the surface tension between the liquid (water) and the vapor (air) interface. A "self-cleaning" event is best described when water drops with a set volume (thus, a set mass) can move by sliding, rolling, or some combination of the two when the waterproof substrate is tilted above the critical angle $\alpha$. Due to the greatly reduced surface tension between water and the waterproof surface, the water droplet slides or roll down leaving no trail. The dirt particles are therefore washed away without trace by sliding or rolling water droplets due to the reduced adhesion of dirt to the waterproof surface. A method for the measurement of the critical water sliding (rolling) angle is shown in FIG. 2*b*. A sessile drop of water with a set volume is placed on the substrate surface tilted at a lower angle than a. A force pushes at the bottom end of the substrate slowly raising it up until the water droplet starts to slide (roll). The critical angle $\alpha$ is then calculated as $\tan^{-1}(y/x)$.

The systems and methods disclosed herein are directed towards providing waterproof coating. The process may involve infiltrating the substrate with chemicals bearing silanol or derivatives thereof, silane or derivatives thereof, and/or metal oxide functional groups using a sol-gel method, and optionally coating that surface with an appropriate hydrophobic chemical agent such as but not limited fluoroalkylsilane and/or related chemicals. In some embodiments, the process may be performed in a controlled environment. In other embodiments, the process can be performed utilizing an all solution process, thereby obviating the need for a controlled environment. The resulting superhydrophobic surface prevents the water "wetting" the substrate (thus becomes "waterproof") and protects the substrate from the consequence (e.g. stain or water damage) caused by the wetting. Beyond hydrophobicity/superhydrophobicity is the ability to use hydrophobic coating in combination with oleophilic layers to enable selective rejection and absorption, such as rejecting water based fluids and absorbing hydrocarbon chemicals.

SUMMARY OF THE INVENTION

In one embodiment, a process for fabricating a waterproof coating may include selecting a substrate, utilizing a sol-gel comprising at least an alkoxysilane or metal oxide precursor to coat the substrate, and optionally coating the substrate with a hydrophobic chemical agent and/or other chemical agents to create a surface with nanoscopic or microscopic features. In some embodiments, the above noted coatings may be deposited in a controlled environment. In other embodiments, the above noted coating may be deposited utilizing an all solution process.

In some embodiments, a sol-gel may comprise at least one alkoxysilane or metal oxide precursor having a general formula of $M(OR)_{4-x}R'_x$ (M=Si, Al, In, Sn or Ti; x=0 to 3), where R and R' can be the same or different and comprise hydrogen, a substituted or unsubstituted alkyl, a substituted or unsubstituted alkenyl, a substituted or unsubstituted alkynyl, a substituted or unsubstituted aryl, a substituted or unsubstituted epoxy, and/or a substituted or unsubstituted amine. In some embodiments, a sol-gel may be silanol, silane, or derivatives thereof.

In some embodiments, the hydrophobic chemical agent(s) may be dissolved or dispersed in an organic solvent or a mixture of organic solvents to deposit utilizing an all solutions process. In other embodiments, the hydrophobic chemical agent(s) may be deposited utilizing a controlled environment. In some embodiments, the hydrophobic chemical agent(s) used may have a general formula of fluoroalkylsilane$[CF_3(CF_2)_a(CH_2)_b]_cSiX_{4-c}$ (where a=0, 1, 2, . . . to 20, b=0, 1, 2, . . . to 10, c=1, 2 or 3; X=Cl, Br, I or other suitable organic leaving groups). In some embodiments, the hydrophobic chemical agent(s) may have a general formula of alkylsilane $[CH_3(CH_2)_a]_bSiX_4$-b (where a=0, 1, 2, . . . to 20, b=1, 2 or 3; X=Cl, Br, I or other suitable organic leaving groups). In some embodiments, the hydrophobic chemical agent(s) used may have a general formula of alkoxyfluoroalkylsilane$[CF_3(CF_2)_a(CH_2)_b]_cSi[alkoxy]_{4-c}$ (where a=0, 1, 2, . . . to 20, b=0, 1, 2, . . . to 10, c=1, 2 or 3; where the alkoxy group can be methoxy, ethoxy, propoxy, isopropoxy, butoxy, isobutoxy, or a combination thereof). In some embodiments, the hydrophobic chemical agent(s) may be dissolved or dispersed in an organic solvent or a mixture of organic solvents. In some embodiments, other chemical agents may be hydrophobic and may have a general formula of alkoxyalkylsilane$[CH_3(CH_2)_a]_bSi[alkoxy]_{4-c}$ (where a=0, 1, 2, . . . to 20, b=0, 1, 2, . . . to 10, c=1, 2 or 3; where the alkoxy group can be methoxy, ethoxy, propoxy, isopropoxy, butoxy, isobutoxy, or a combination thereof). In some embodiments, the hydrophobic chemical agent(s) may be dissolved or dispersed in an organic solvent or a mixture of organic solvents.

The foregoing has outlined rather broadly various features of the present disclosure in order that the detailed description that follows may be better understood. Additional features and advantages of the disclosure will be described hereinafter.

BRIEF DESCRIPTION OF THE DRAWINGS

For a more complete understanding of the present disclosure, and the advantages thereof, reference is now made to the following descriptions to be taken in conjunction with the accompanying drawings describing specific embodiments of the disclosure, wherein:

FIGS. 9*a*-9*d* are illustrative examples of (a) water on untreated concrete, (b) water on treated concrete, (c) water on untreated brick and (d) water on treated brick;

FIGS. 10*a*-10*b* are illustrative examples of (a) water on treated tarpaulin and (b) water on untreated tarpaulin.

DETAILED DESCRIPTION OF THE INVENTION

It is to be understood that both the foregoing general description and the following detailed description are exemplary and explanatory only, and are not restrictive of the invention, as claimed. In this application, the use of the singular includes the plural, the word "a" or "an" means "at least one", and the use of "or" means "and/or", unless specifically stated otherwise. Furthermore, the use of the term "including", as well as other forms, such as "includes" and "included", is not limiting. Also, terms such as "element" or "component" encompass both elements or components comprising one unit and elements or components that comprise more than one unit unless specifically stated otherwise.

Methods and composition for making and using of waterproof coatings are discussed herein. Methods for forming a water proof coating may comprise selecting a substrate, and coating the substrate a sol-gel. The sol-gel may comprise silanol, silane, alkylsilane, alkoxysilane, metal oxide, and/or derivatives thereof. The method may also comprise coating the substrate with a hydrophobic chemical agent. The hydrophobic chemical agent may be any suitable hydrophobic chemical or combination of hydrophobic chemicals as discussed further herein. In some embodiments, one or more of the coating steps may be performed in a controlled environment. In other embodiments, the coating steps may utilize an all solution process that does not require a controlled environment.

Figure 1A:
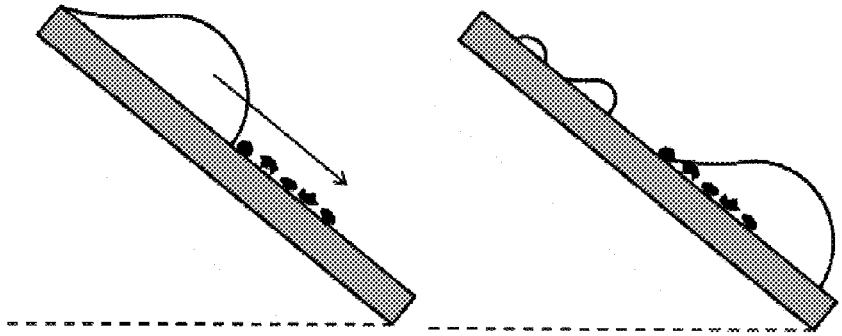
FIGS. 1*a*-1*c* illustrate a general phenomenon where a water droplet slides down a tilted (a) untreated substrate surface, a tilted substrate surface that has been previously treated with a waterproof coating and (c) a tilted substrate surface treated that has been previously treated with a waterproof coating with nano/microscopic features.
Figure 1B:
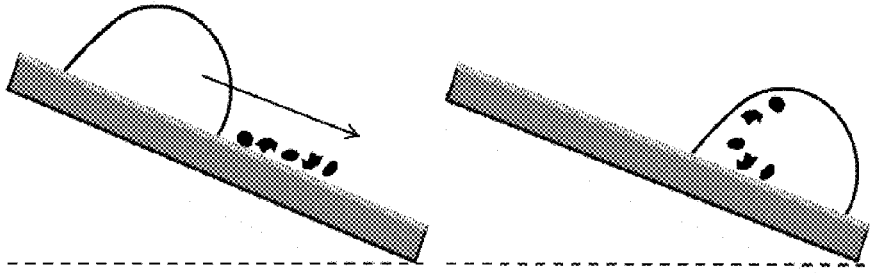
Figure 1C:
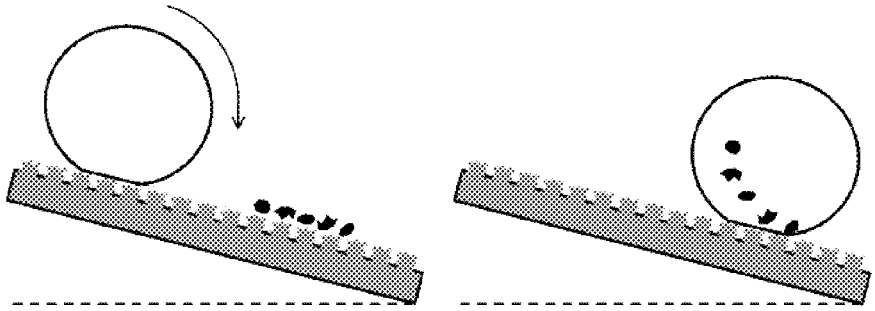

FIG. 1*c* describes phenomenon where a water droplet rolls down a tilted substrate surface that has been previously treated with a waterproof coating with nanoscopic/microscopic features. Due to the greatly reduced surface tension and contact area between water and the coated substrate surface, the water droplet rolls down leaving no trail. The adhesion between the dust particles and the coated substrate surface is also reduced so the particles are washed away (depicted in black) when they are in contact with the water droplet.

Figure 3A:
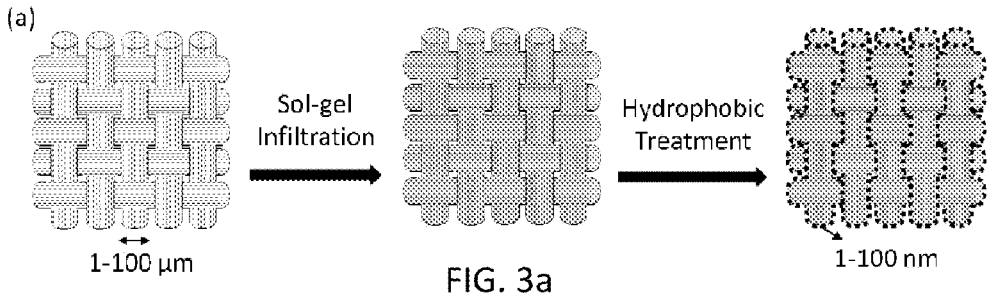
FIGS. 3*a*-3*b* illustrate an exemplary general process to transform the surface of interest into a superhydrophobic one.
Figure 3B:
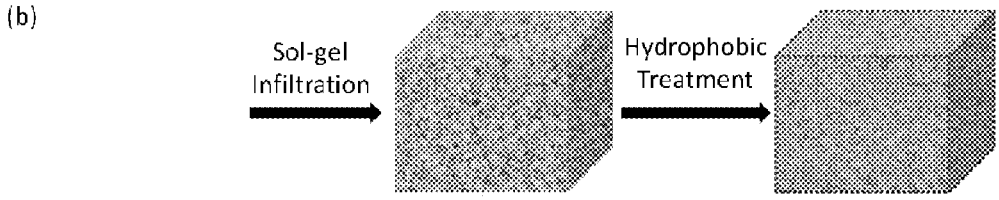

FIGS. 3*a*-3*b* are exemplary illustrations of a general processes to transform a surface of interest into a superhydrophobic one. This method is suitable for any materials as long as they are compatible with a sol-gel process discussed further below. For example, the material to form hydrophobic/superhydrophobic may be a natural polymer, man-made polymer, inorganic materials, or any other material that is compatible with the sol-gel process discussed herein. Substrates of these materials can be in any kind of forms. In a preferred embodiment, the surfaces of substrates bear nanoscopic/microscopic features equal to or between about 1 nm to 100 μm. Nanoscopic/microscopic features as discussed herein are nano or micro scale surface features that reduce surface tension in comparison to a substantially flat surface and reduce the contact area between the surface and a water droplet. It will be understood by one of ordinary skill in the art that nanoscopic features discussed herein can be substituted with microscopic features or vice versa. Nonlimiting examples of nanoscopic or microscopic features may include grooves, an interpenetration network, pores, a combination thereof, or the like. The selected substrates may also include antibacterial and antimicrobial properties that are aided or enhanced by the hydrophobic/superhydrophobic layers on top, or as a composite. For example, the substrate may be woven fibers, such as cotton/wool cloth and polymer tarpaulin; non-woven fibers, such as paper; or natural/man-made inorganic structures, such as stone or concrete bricks.

More specifically, embodiments of the compositions and methods for making superhydrophobic/waterproof coatings may comprise the following steps: Step 1) choosing any substrate of interest. It is preferred that the substrate be clean prior to processing. Thus, in some embodiments, it may be desirable to wash or clean the substrate. By way of example, the substrate may be any suitable materials, as long as the materials are compatible with silane, silanol, or metal oxide sol-gel process. Nonlimiting examples include natural polymers such as cellulose or proteins, man-made polymers such as polyesters, polyamides, polyether and copolymer such as poly(ethylene terephthalate) and poly(ketone ethylene ether), or inorganic materials such as glass, clay or ceramics. The substrates which are made of these materials can be in any suitable form or shape. In some embodiments, the substrates may bear a microstructure equal to or between about 1 nm to 100 μm prior to processing. As a nonlimiting example, the substrate may be in the form of woven fibers, such as cotton, wool cloth, and polymer tarpaulin, or non-woven fibers, such as paper and wood, or natural/man-made inorganic structure, such as stone or concrete bricks.

Step 2) coating the substrate with silane, silanol, metal oxide(s), or derivatives thereof utilizing any suitable deposition method. In some embodiments, depending on the substrate selected, it may be desirable to coat the substrate with a primer to aid adhesion of the sol-gel prior to the sol-gel coating step. In some embodiments, the coating may be a sol-gel comprising silanol or derivatives thereof, silane or derivatives thereof, alkoxysilane or derivatives thereof, alkylsilane or derivatives thereof, metal oxide precursor, or combinations thereof. As a nonlimiting example a sol-gel solution may be prepared in solvents, such as water, alcohols, ethers, esters and/or ketones, that can be sprayed or doctor-bladed on the substrate or the substrate may be dipped into the sol-gel solution for a set period. For example, the substrate may be treated for a period of time equal to or between about 1 minute and 24 hour. The solvent may then be removed from the substrate and the sol-gel coated substrate may be cured at a set temperature equal to or between about 25 and 200° C. Further, in some embodiments, the substrate may optionally be kept at a set pressure, such as a pressure equal to or between about 0.001 to 10 atm, for a set period time, such as a time equal to or between about 1 second to 24 hours to form an interpenetration polymer network within the substrate as illustrated in FIG. 3*a*-3*b*. While some embodiments utilize a gas phase reaction that necessitates the use of a controlled environment, other embodiments may utilize a deposition process that operates in a solution phase. An interpenetration polymer network is defined as a combination of two or more polymers in network form which are synthesized in juxtaposition. Thus, there is some type of interpenetration form finely divided phases. The two or more polymer are at least partially interlaced on a polymer scale, but not covalently bonded to each other. The network cannot be separated unless chemical bonds are broken. The two or more networks can be envisioned to be entangled in such a way that they are concatenated and cannot be pulled apart, but not bonded to each other by any chemical bond. The interpenetration polymer network may exhibit dual phase continuity, which means that two/three or more polymers/oligomers/dimers in the system form phases that are continuous on a macroscopic scale. In some embodiments, a nanoscopic topology may be created by the polymerization/crosslinking reaction occurring on top of the microscopic features.

In some embodiments, the substrate is treated with a solution of silanol or metal oxide sol-gel by dipping, spraying or doctor-blading for a set period of time equal to or between 1 minute and 24 hour. In the second step, the solvent is then removed from the substrate and the sol-gel coated substrate is cured at a set temperature equal to or between 25 and 200° C. to form an interpenetration polymer network within the substrate.

In some embodiments, the substrate may be treated with a sol-gel solution that comprises at least one alkoxysilane or metal oxide precursor having a general formula of $M(OR)_{4-x}R'_x$ (M=Si, Al, In, Sn or Ti; x=0 to 3), where R and R' can be the same or different and comprise hydrogen, a substituted or unsubstituted alkyl, a substituted or unsubstituted alkenyl, a substituted or unsubstituted alkynyl, a substituted or unsubstituted aryl, a substituted or unsubstituted epoxy, and/or a substituted or unsubstituted amine. An example of such sol-gel solution includes, but is not limited to, a solution comprised of such formula with tetraethyl orthosilicate, trimethoxy(propyl)silane, 3-glycidoxypropyltrimethoxysilane, water, $HCl_{(aq)}$ and methanol/ethanol. For example, the substrate may be soaked into a solution of silanol or metal oxide sol-gel for a set period of time by dipping or spraying equal to or between about 1 second and 24 hours. The solvent is then removed from the substrate and the sol-gel is cured at a set temperature equal to or between 25 and 200° C. to form an interpenetration polymer network within the substrate.

In some embodiments, one or more functional additives may be added into the sol-gel solution while the additives do not impair the original functions of the sol-gel layer. Here the functional additives may have the properties of, but not limited to, UV absorbing/blocking, anti-reflective, fire-retardant, conducting or anti-microbial. The additives can be composed of, but not limited to, organic/inorganic molecules/polymers having molecular weight up to about 100,000 Da, organic micro/nano materials (e.g. carbon black, graphite, graphene, and carbon nanotube) in their natural or synthetic forms (e.g. particles, nanotubes and nanosheets) having sizes equal to or between about 1 nm to 500 μm; metal/metal oxide micro/nano materials (e.g. silver, titanium oxide, zinc oxide, aluminum oxide and clay) in their natural or synthetic forms (e.g. particles, nanotubes and nanosheets) having sizes equal to or between about 1 nm to 500 μm; and combinations thereof.

Figure 4:
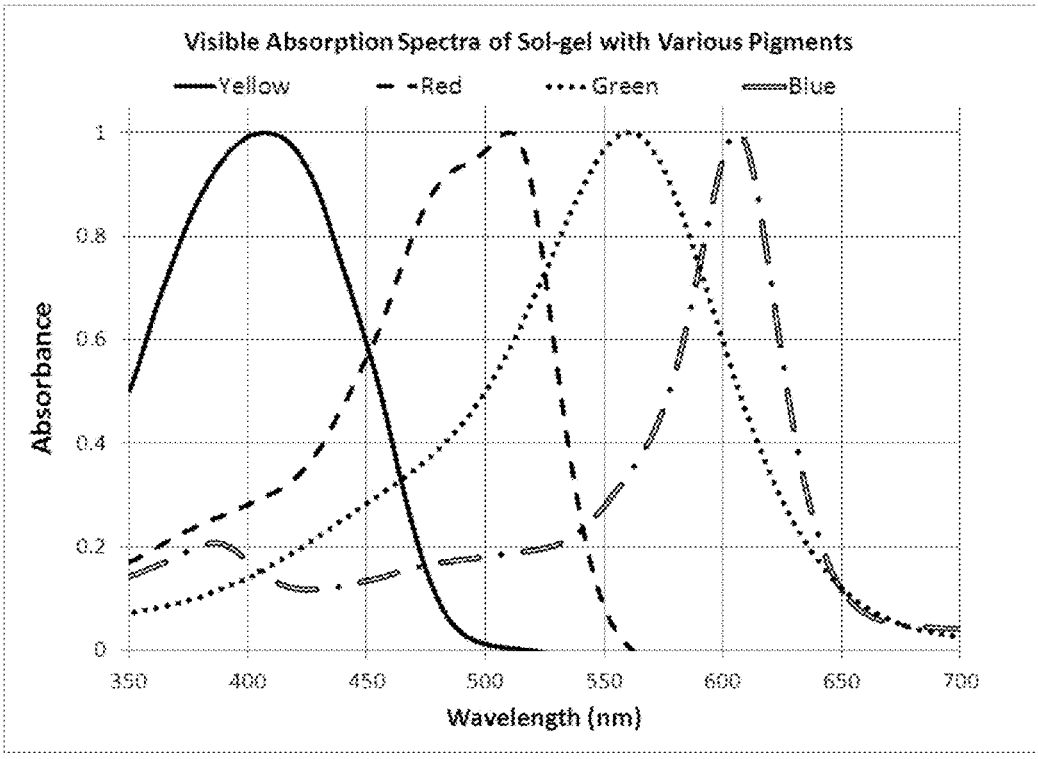
FIG. 4 is an exemplary collection of spectra from sol-gel solutions mixed with organic pigments showing different colors.

In some embodiments, one or more pigments, which do not impair the original functions of the sol-gel layer, may be added into the sol-gel solution. Such pigments may include materials that change the color of reflected or transmitted light as the result of wavelength-selective absorption. Non-limiting examples include the range of wavelengths humans can perceive, such as wavelength from approximately 390 to 700 nm. The pigments may include, but are not limited to, metal-based inorganic pigments containing metal elements such as Cadmium, Chromium, Cobalt, Copper, Iron oxide, Lead, Manganese, Mercury, Titanium and Zinc; other inorganic pigments such as Carbon, Clay earth and Ultramarine; organic pigments such as alizarin, alizarin crimson, gamboge, carmine, purpurin, indigo, Indian yellow, Tyrian purple, quinacridone, magenta, phthalo green, phthalo blue, diarylide yellow, pigment red, pigment yellow, pigment green, pigment blue and other inorganic or organic derivatives thereof. FIG. 4 is an exemplary collection of absorption spectra from sol-gel solutions mixed with organic pigments showing color yellow (with Pigment Yellow 5); color red (with Pigment Red 3 and Red 40); color green (with Pigment Yellow 5 and Blue 1) and color blue (with Pigment Blue 1 and Red 40). In some embodiments, pigments may also include materials that emit colors, such as through fluorescence, phosphorescence, and/or other forms of luminescence. Such pigments may include but are not limited to fluorophores, such as Fluorescein, Rhodamine, Coumarin, Cyanine and their derivatives; phosphorescent dyes such as Zinc sulfide, Strontium aluminate and their derivatives.

In the some embodiments, a sol-gel solution may be comprised of tetraethyl orthosilicate, trimethoxy(propyl) silane, 3-glycidoxypropyltrimethoxysilane, water, $HCl_{(aq)}$ and methanol/ethanol is used to form an interpenetration polymer network within the substrate.

Figure 5A:
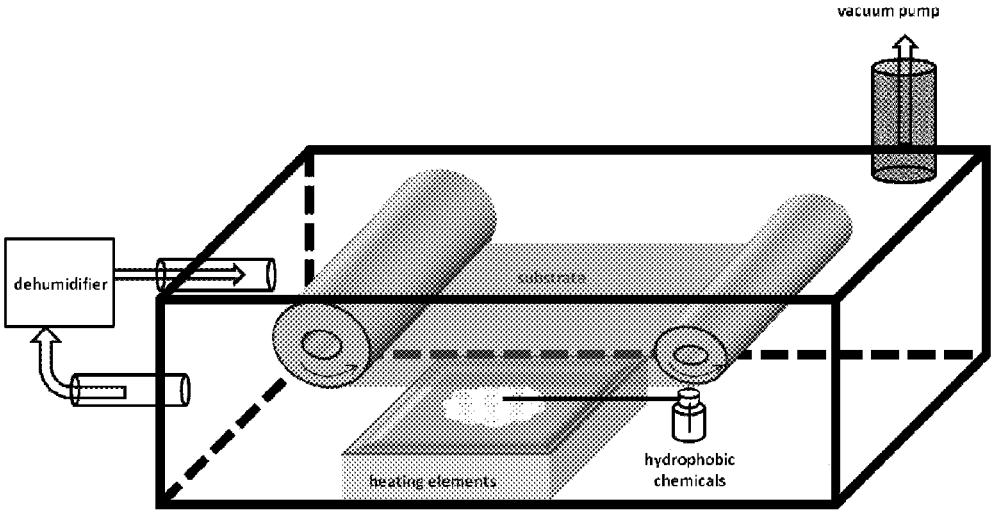
FIG. 5*a* is an illustrative embodiment of a process for conducting the hydrophobic treatment on a flexible substrate without solvents.
Figure 5B:
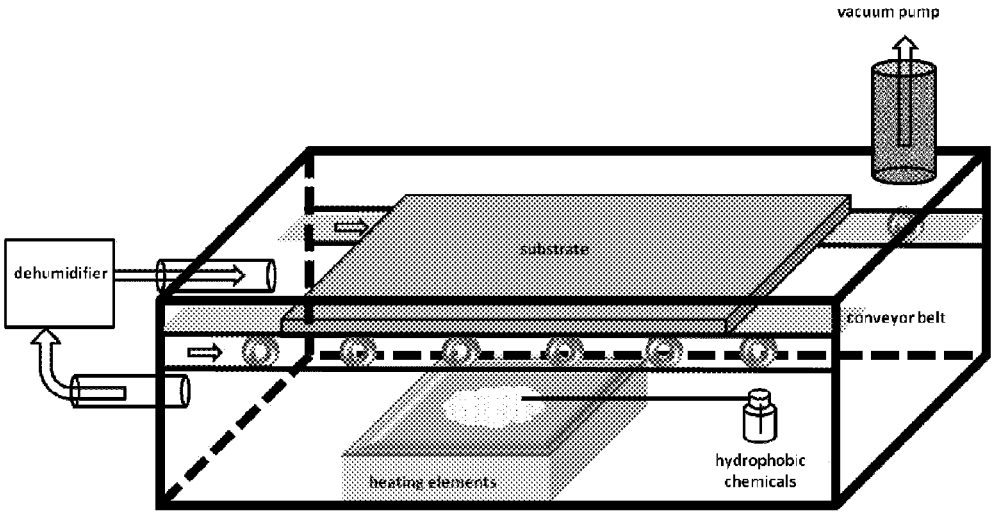
FIG. 5*b* is an illustrative embodiment of a process for conducting the hydrophobic treatment on a rigid substrate without solvents.

Step 3) optionally coating the substrate with a hydrophobic chemical agent and/or other chemical agent(s) to create a surface with nanoscale or microscale features. In some embodiments, this coating step may be performed utilizing an all solution process that utilizes liquid phase solution(s) throughout the coating step. For example, any suitable solution deposition process may be utilized, such as dip-coating, spraying, immersion of the substrate, inkjet printing, or the like. In other embodiments, this coating step may be performed in a controlled environment if necessary as illustrated in FIG. 5A or 5B. For example, chemical agent may be applied using a chemical vapor deposition. The deposition can be carried out at a set temperature, such as a temperature equal to or between about 25 and 300° C., and at a set pressure, such as a pressure equal to or between about 0.001 to 10 atm, for a set period time, such as a time period equal to or between about 1 second and 24 hours. In some embodiments, the hydrophobic chemical agent may have a general formula of fluoroalkylsilane $[CF_3(CF_2)_a(CH_2)_b]_cSiX_{4-c}$ (where a=0, 1, 2, . . . to 20, b=0, 1, 2, . . . to 10, c=1, 2 or 3; X=Cl, Br, I or other suitable organic leaving groups). In some embodiments, the hydrophobic chemical agent may be dissolved or dispersed in an organic solvent or a mixture of organic solvents. In some embodiments, other chemical agents may be hydrophobic and may have a general formula of alkylsilane$[CH_3(CH_2)_a]_bSiX_{4-c}$ (where a=0, 1, 2, . . . to 20, b=1, 2 or 3; X=Cl, Br, I or other suitable organic leaving groups). In some embodiments, the hydrophobic chemical agent may be dissolved or dispersed in an organic solvent or a mixture of organic solvents. In some embodiments, the hydrophobic chemical agents used may have a general formula of alkoxyfluoroalkylsilane$[CF_3(CF_2)_a(CH_2)_b]_cSi[alkoxy]_{4-c}$ (where a=0, 1, 2, . . . to 20, b=0, 1, 2, . . . to 10, c=1, 2 or 3; where the alkoxy group can be methoxy, ethoxy, propoxy, isopropoxy, butoxy, isobutoxy, or a combination thereof). In some embodiments, the hydrophobic chemical agent may be dissolved or dispersed in an organic solvent or a mixture of organic solvents. In some embodiments, other chemical agents may be hydrophobic and may have a general formula of alkoxyalkylsilane$[CH_3(CH_2)_a]_bSi[alkoxy]_{4-c}$ (where a=0, 1, 2, . . . to 20, b=0, 1, 2, . . . to 10, c=1, 2 or 3; where the alkoxy group can be methoxy, ethoxy, propoxy, isopropoxy, butoxy, isobutoxy, or a combination thereof). In some embodiments, the hydrophobic chemical agent may be dissolved or dispersed in an organic solvent or a mixture of organic solvents. The chemical agent creates a hydrophobic surface with nano/microscopic topography which increases the total surface area. Here the nano/microscopic topography is defined as a three-dimensional surface arrangement with a surface height variation equal to or between about 5 nm and 300 μm. In some embodiments, the nano/microscopic topography is utilized to increase hydrophobic properties by minimize surface area that may come in contact with a liquid. In some embodiments, a microscopic topology may be created by the substrate itself, such as the weave of the fabric or texture of the substrate. In some embodiments, it may be desirable to texturize the surface of the material that the coating is to be deposited on. In some embodiments, a nanoscopic or microscopic topology may be created by the polymerization/crosslinking reaction occurring on top of the microscopic features.

In the third step of the process, the resulting surface is then treated with hydrophobic chemical agents, which renders the surface hydrophobic and also generates nano/microscopic topography equal to or between about 5 nm to 300 μm. The resulting hierarchical micro/nanostructures with hydrophobic nature render the substrate superhydrophobic/waterproof.

In some embodiments, after the substrate is treated with the sol-gel process, the resulting surface may then be treated with hydrophobic chemical agents and/or other chemical agents, which renders the surface hydrophobic/superhydrophobic and also generates nanoscopic or microscopic topography. As a nonlimiting example of hydrophobic chemical agents used as coating in Step 3 includes at least one type of fluoroalkylsilane covalently bonded to the resulting surface, which renders the surface hydrophobic/superhydrophobic and also generates nanoscopic or microscopic topography. In some embodiments, the hydrophobic chemical agents used may have a general formula of fluoroalkylsilane$[CF_3(CF_2)_a(CH_2)_b]_cSiX_{4-c}$ (where a=0, 1, 2, . . . to 20, b=0, 1, 2, . . . to 10, c=1, 2 or 3; X=Cl, Br, I or other suitable organic leaving groups). In some embodiments, the hydrophobic chemical agent may be dissolved or dispersed in an organic solvent or a mixture of organic solvents. The preferred fluoroalkylsilane species may include, but are not limited to, trichloro(3,3,3-trifluoropropyl)silane, dichloro-methyl(3,3,3-trifluoropropyl)silane, chloro-dimethyl(3,3,3-trifluoropropyl) silane, trichloro(1H,1H,2H,2H-perfluorohexyl)silane, dichloro-methyl(1H,1H,2H,2H-perfluorohexyl)silane, chloro-dimethyl(1H,1H,2H,2H-perfluorohexyl)silane, trichloro(1H,1H,2H,2H-perfluorooctyl)silane, dichloro-methyl(1H,1H,2H,2H-perfluorooctyl)silane, chloro-dimethyl(1H,1H,2H,2H-perfluorooctyl)silane, trichloro(1H,1H,2H,2H-perfluorodecyl)silane, dichloro-methyl(1H,1H,2H,2H-perfluorodecyl)silane, chloro-dimethyl(1H,1H,2H,2H-perfluorodecyl)silane, trichloro(1H,1H,2H,2H-perfluorododecyl)silane, dichloro-methyl (1H,1H,2H,2H-perfluorododecyl) silane, chloro-dimethyl(1H,1H,2H,2H-perfluorododecyl)silane and derivatives bearing similar structures. In some embodiments, the hydrophobic chemical agent(s) may be dissolved or dispersed in one or more organic solvents. The preferred organic solvents may include but not limited to toluene, benzene, xylene, trichloroethylene, 1,2-dichloroethane, dichloromethane, chloroform, carbon tetrachloride, tetrachloroethylene, n-propyl bromide, diethyl ether, diisopropyl ether, and/or methyl-t-butyl ether. Other chemical agents may also be used alone or in conjunction with fluoroalkylsilanes to perform similar tasks to render the surface hydrophobic and/or to generate nanoscopic topography. In some embodiments, other chemical agents may be hydrophobic and may have a general formula of alkylsilane$[CH_3(CH_2)_a]_bSiX_{4-c}$ (where a=0, 1, 2, . . . to 20, b=1, 2 or 3; X=Cl, Br, I or other suitable organic leaving groups). In some embodiments, the chemical agent(s) may be dissolved or dispersed in an organic solvent or a mixture of organic solvents. The preferred alkylsilane species may include, but are not limited to, chlorosilane, dichlorosilane, trichlorosilane, chlorotrimethylsilane, dichlorodimethylsilane, trichloromethylsilane, chlorophenylsilane, dichlorophenylsilane, trichlorophenylsilane, chloromethylphenylsilane, chlorodimethylphenylsilane, dichloromethylphenylsilane, chlorodimethylphenethylsilane, dichloromethylphenethylsilane, trichlorophenethylsilane, chlorodimethyloctylsilane, dichloromethyloctylsilane trichlorooctylsilane, chlorodimethyldodecylsilane, dichloromethyldodecylsilane, trichlorododecylsilane, chlorodecyldimethylsilane, dichlorodecylmethylsilane, trichlorodecylsilane, chlorodimethyloctadecylsilane, dichloromethyloctadecylsilane, trichlorooctadecylsilane, chlorodimethylthexylsilane, dichloromethylthexylsilane, trichlorothexylsilane, allyldichloromethylsilane, allylchlorodimethylsilane, allyltrichlorosilane, (cyclohexylmethyl) chlorodimethylsilane, (cyclohexylmethyl)dichloromethylsilane, (cyclohexylmethyl)trichlorosilane and derivatives bearing similar structures. In some embodiments, the hydrophobic chemical agent(s) may be dissolved or dispersed in one or more organic solvents. The preferred organic solvents may include but not limited to toluene, benzene, xylene, trichloroethylene, 1,2-dichloroethane, dichloromethane, chloroform, carbon tetrachloride, tetrachloroethylene, n-propyl bromide, diethyl ether, diisopropyl ether, and/or methyl-t-butyl ether. Other chemical agents may also be used alone or in conjunction with fluoroalkylsilanes or alkylsilanes to perform similar tasks to render the surface hydrophobic and/or to generate nanoscopic topography.

In some embodiments, an example of hydrophobic chemical agents used as coating in Step 3 includes at least one type of alkoxyfluoroalkylsilane covalently bonded to the resulting surface, which renders the surface hydrophobic/superhydrophobic and also generates nanoscopic topography. The hydrophobic chemical agents used may have a general formula of alkoxyfluoroalkylsilane$[CF_3(CF_2)_a(CH_2)_b]_cSi[alkoxy]_{4-c}$ (where a=0, 1, 2, . . . to 20, b=0, 1, 2, . . . to 10, c=1, 2 or 3; where the alkoxy group can be methoxy, ethoxy, propoxy, isopropoxy, butoxy, isobutoxy, or a combination thereof). In some embodiments, the hydrophobic chemical agent may be dissolved or dispersed in an organic solvent or a mixture of organic solvents. The preferred alkoxyfluoroalkylsilane species may include, but are not limited to, trimethoxy(3,3,3-trifluoropropyl)silane, triethoxy(3,3,3-trifluoropropyl)silane, tripropoxy(3,3,3-trifluoropropyl)silane, triisopropoxy(3,3,3-trifluoropropyl)silane, trimethoxy(1H,1H,2H,2H-perfluorohexyl)silane, triethoxy(1H,1H,2H,2H-perfluorohexyl)silane, tripropoxy(1H,1H,2H,2H-perfluorohexyl)silane, triisopropoxy(1H,1H,2H,2H-perfluorohexyl) silane, trimethoxy(1H,1H,2H,2H-perfluorooctyl)silane, triethoxy(1H,1H,2H,2H-perfluorooctyl)silane, tripropoxy (1H,1H,2H,2H-perfluorooctyl)silane, triisopropoxy(1H,1H,2H,2H-perfluorooctyl)silane, trimethoxy(1H,1H,2H,2H-perfluorodecyl)silane, triethoxy(1H,1H,2H,2H-perfluorodecyl)silane, tripropoxy(1H,1H,2H,2H-perfluorodecyl)silane, triisopropoxy(1H,1H,2H,2H-perfluorodecyl)silane, trimethoxy(1H,1H,2H,2H-perfluorododecyl)silane, triethoxy(1H,1H,2H,2H-perfluorododecyl)silane, tripropoxy(1H,1H,2H,2H-perfluorododecyl)silane, triisopropoxy(1H,1H,2H,2H-perfluorododecyl)silane and derivatives bearing similar structures. The preferred organic solvents may include, but are not limited to, methanol, ethanol, n-propanol, isopropanol, acetone, acetonitrile, dioxane, tetrahydrofuran, tetrachloroethylene, n-propyl bromide, dimethylformamide, dimethyl sulfoxide and water. Other chemical agents may also be used alone or in conjunction with alkoxyfluoroalkylsilanes to perform similar tasks to render the surface hydrophobic and/or to generate nanoscopic topography. In some embodiments, other chemical agents may be hydrophobic and may have a general formula of alkoxyalkylsilane $[CH_3(CH_2)_a]_bSi[alkoxy]_{4-c}$ (where a=0, 1, 2, . . . to 20, b=0, 1, 2, . . . to 10, c=1, 2 or 3; where the alkoxy group can be methoxy, ethoxy, propoxy, isopropoxy, butoxy, isobutoxy, or a combination thereof). In some embodiments, the hydrophobic chemical agent may be dissolved or dispersed in an organic solvent or a mixture of organic solvents. The preferred alkoxyalkylsilane species may include, but are not limited to, trimethoxy(hexyl)silane, triethoxy(hexyl)silane, tripropoxy(hexyl)silane, triisopropoxy(hexyl)silane, trimethoxy(octyl)silane, triethoxy(octyl)silane, tripropoxy (octyl)silane, triisopropoxy(octyl)silane, trimethoxy(decyl) silane, triethoxy(decyl)silane, tripropoxy(decyl)silane, triisopropoxy(decyl)silane, trimethoxy(dodecyl)silane, triethoxy(dodecyl)silane, tripropoxy(dodecyl)silane, triisopropoxy(dodecyl)silane and derivatives bearing similar structures. The preferred organic solvents may include, but are not limited to, methanol, ethanol, n-propanol, isopropanol, acetone, acetonitrile, dioxane, tetrahydrofuran, tetrachloroethylene, n-propyl bromide, dimethylformamide, dimethyl sulfoxide and water. Other chemical agents may also be used alone or in conjunction with alkoxyalkylsilanes to perform similar tasks to render the surface hydrophobic and/or to generate nanoscopic topography.

In some embodiments, the superhydrophobic/waterproof coating may utilize trichloro(1H,1H,2H,2H-perfluorooctyl) silane in anhydrous toluene, trichloro(3,3,3-trifluoropropyl) silane in anhydrous toluene, trimethoxy(1H,1H,2H,2H-perfluorooctyl)silane in methanol or trimethoxy(3,3,3-trifluoropropyl)silane in methanol to render the surface hydrophobic/superhydrophobic and generates nano/microscopic topography by virtue of the nanolayers deposited. In some embodiments, the concentration of hydrophobic chemical agents in their respective organic solvents ranges may be equal to or between 0.5 and 15 (v/v) %. The resulting hydrophobic/superhydrophobic surface prevents the water "wetting" the substrate (thus becomes "waterproof") and protects the substrate from the consequence (e.g. stain or water damage) caused by the wetting.

In some embodiments, the superhydrophobic/waterproof coating may utilize trichlorooctylsilane in anhydrous toluene or trimethoxyoctylsilane in methanol to render the surface hydrophobic and generates nanoscopic or microscopic topography. The concentration of hydrophobic chemical agents in their respective organic solvents ranges may be equal to or between 0.5 and 15 (v/v) %. The resulting superhydrophobic surface prevents the water "wetting" the substrate (thus becomes "waterproof") and protects the substrate from the consequence (e.g. stain or water damage) caused by the wetting. In addition, the substrate may become oleophilic (having a strong affinity for oils and hydrocarbons such as gasoline and diesel rather than water), which can be useful for oil-water separation applications (e.g. recover of oil spill and recycle of diesel-based drilling fluid). For example, samples providing a coating of alkylsilane, alkoxyalkylsilane, or derivatives thereof may become oleophilic.

In some cases, the selected substrate may already bear the desired silane, silanol, or metal oxide functional groups, such as glass, metal oxide fibers/nanotubes or ceramics. In these embodiments, only the third step is required to render the substrate superhydrophobic/waterproof. In other cases, the surface chemistry and topography of the sol-gel after the curing step (the second step) may already renders the substrate waterproof. In such cases, only the first and the second step are required for the process.

To generate the desired nanoscopic topography, a well-controlled environment may be utilized for the hydrophobic treatment. FIG. 5A is an illustrative embodiment of a process for conducting the hydrophobic treatment on a flexible substrate without solvents. The substrate is suspended on a fixture located at the top of the enclosure. While a roll-to-roll configuration is shown, there is no limitation of the configuration and the configuration may be dependent on the physical form of the substrate. The hydrophobic chemicals, such as fluoroalkylsilanes, are injected on the top of heating elements. The evaporation of the chemicals is controlled by the heating temperature, which is adjusted by the heating elements, and the pressure, that is adjusted by the vacuum/heating pump. The vacuum/heating pump may be coupled with chemical filters. In order to generate nanoscopic topography, extra water molecules may be needed to promote polymerization of the hydrophobic chemicals. The humidity level is controlled though the dehumidifier to be equal to or between about 1 and 50% of related humidity. After the reaction between the hydrophobic chemicals and the surface is completed, the excess amount chemicals are removed by the vacuum/heating pump and the resulting substrate is removed from the enclosure and may be dried under ambient conditions.

To generate the desired nanoscopic or microscopic topography, a well-controlled environment may be utilized for the hydrophobic/superhydrophobic treatment. FIG. 5B is an illustrative embodiment of a process for conducting the hydrophobic treatment on a rigid substrate without solvents. The substrate is suspended on a fixture located at the top of the enclosure. A conveyor belt configuration is demonstrated here although there is no limitation of the configuration and it depends on the physical form of the substrate. The hydrophobic chemicals, such as fluoroalkylsilanes, are injected on the top of heating elements. The evaporation of the chemicals is controlled by the heating temperature, which is adjusted by the heating elements, and the pressure, which is adjusted by the vacuum pump. The vacuum pump may be coupled with chemical filters. In order to generate nanoscopic topography, extra water molecules may be needed to promote polymerization of the hydrophobic/superhydrophobic chemicals. The humidity level is controlled though the dehumidifier to be equal to or between about 1 and 50% of related humidity. Once the reaction is completed, the substrate is removed from the fixture and may be dried under ambient conditions.

In some embodiments, the methods to deposition sol-gel and/or hydrophobic chemical solution may utilize and all solution process. The sol-gel solution or hydrophobic chemical agent may be formed as a solution that may be deposited by any suitable deposition technique for depositing materials in a liquid phase, such as dip coating, immersing the substrate in the solution, spray coating, ink jet printing, or the like. In some embodiments, the substrate may be allowed to dry after coating. Further, some embodiments may cure the substrate after the sol-gel and/or hydrophobic chemical deposition.

In some embodiments, the methods to deposition sol-gel and hydrophobic chemical solution can vary depending on the substrates of interest which are listed individually in the following experimental examples. In some embodiments, the deposition process utilizes an all solutions process and does not require a controlled environment, thereby allowing a greater variety of materials to be treated. Materials to be treated in a controlled environment may be constrained in size and shape by the controlled environment, whereas the all solutions process obviates these constraints and significantly simplifies the deposition process. The chemical solutions described below used to treat various glass, fabric/textile, carpet, thread and wood materials, vary in their chemical constituents, concentration of reagents in solution, and deposition procedure. The composition of glass, fabric/textile, carpet, thread and wood materials that can be treated with the various treatments described below span an assortment of differing fiber species of both natural and/or synthetic, including but not limited to cotton, wool, silk, polyamide (nylon-6 and nylon-6,6), polyolefin, polyester, and their mixtures; and wood species including but not limited to particle board/wood composite, whitewood and western red cedar. The following sections are structured and arranged by the particular material type to be treated (e.g. glass, fabrics/textiles, carpets, threads and wood). Correspondingly, each material type will contain discussion about the composition of material, particular chemical solution(s) used, depositional procedure, and relevant experimental results.

EXPERIMENTAL EXAMPLE

The following examples are included to demonstrate particular aspects of the present disclosure. It should be appreciated by those of ordinary skill in the art that the methods described in the examples that follow merely represent illustrative embodiments of the disclosure. Those of ordinary skill in the art should, in light of the present disclosure, appreciate that many changes can be made in the specific embodiments described and still obtain a like or similar result without departing from the spirit and scope of the present disclosure.

The following describes the general pre-treatment procedure for substrate preparation. To achieve optimal deposition, any glass, fabric, textile, carpet, thread or wood substrate to which any of the aforementioned solutions listed in the preceding section are to be applied must be thoroughly and properly cleaned prior to deposition to aid in removing any extraneous loose fibers or soiling clinging to the substrate. For each particular substrate, refer to the washing/cleaning instructions provided by the manufacturer of the fabric material. Avoid the use of fabric softeners as they typically contain ionic surfactants that could affect the deposition process. Prior to applying any of the solutions listed in the preceding section in accordance with the appropriate and corresponding deposition procedure described below, ensure that the material to be treated is completely dry; excess moisture content retained by the fibers of fabric materials to be treated with any of the solutions listed in the preceding section could potentially result in a change in the texture of the material and overall coating performance. Once dry, materials to be treated may be stored at or close to room conditions (25±10° C., 50% relative-humidity) until ready for treatment.

The following describes the coating procedure of a blue denim cloth made of 100% cotton. A sol-gel solution comprising various ratios of tetraethyl orthosilicate, trimethoxy(propyl)silane, 3-glycidoxypropyltrimethoxysilane, water, HCl(aq) and ethanol was prepared by mixing the above chemicals at 60° C. for 12 hours. The denim cloth was then soaked in the 10% of the above sol-gel solution (diluted with ethanol) for 10 minutes. After drying off the solvent at 25° C. under ventilation, the denim cloth was cured at 80° C. for 1 hour. After curing, the denim cloth was subjected to the trichloro(1H,1H,2H,2H-perfluorooctyl)silane vapor (the vapor is generated by heating the chemical on a 100° C. hotplate) in an enclosure for 15 minutes. The procedure was completed after removing the denim cloth from the enclosure.

Figures 6A, 6B:
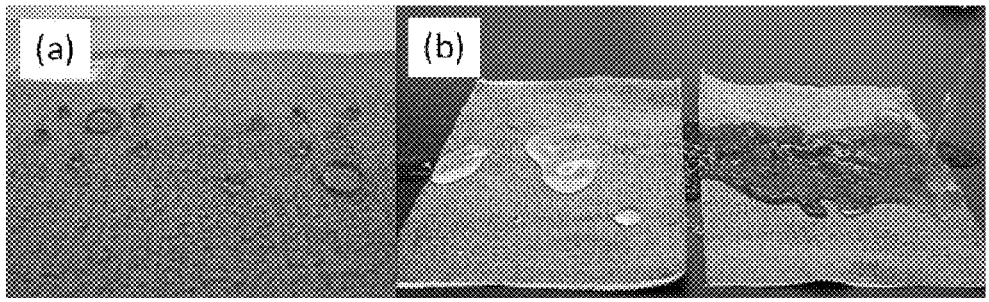
FIGS. 6*a*-6*b* are illustrative examples of (a) colored water droplets on denim treated with a waterproof coating and (b) water being poured on a piece of treated denim (left) next to a piece of untreated denim (right)

FIGS. 6*a*-6*b* are illustrative examples of (a) colored water droplets on denim treated with a waterproof coating and (b) water being poured on a piece of treated denim (left) next to a piece of untreated denim (right). The denim is 100% cotton. The droplets can roll off the denim easily without leaving any stain. FIG. 6*b* shows water being poured on top of a piece of coated denim (left) and a piece of regular denim (right). The water rolls off the coated denim but wets the regular one completely.

The following describes the coating procedure of a carpet made of 100% polyester. A sol-gel solution comprising various ratios of tetraethyl orthosilicate, trimethoxy(propyl)silane, 3-glycidoxypropyltrimethoxysilane, water, HCl(aq) and ethanol was prepared by mixing the above chemicals at 60° C. for 12 hours. The carpet was then wetted completely by dipping or spraying the 10% of the above sol-gel solution (diluted with ethanol). After drying off the solvent at 25° C. under ventilation, the carpet was cured at 80° C. for 1 hour. After curing, the carpet was subjected to the trichloro(1H,1H,2H,2H-perfluorooctyl)silane vapor (the vapor was generated by heating the chemical on a 100° C. hotplate) in an enclosure for 15 minutes. The procedure was completed after removing the carpet from the enclosure.

Figures 7A, 7B, 7C:
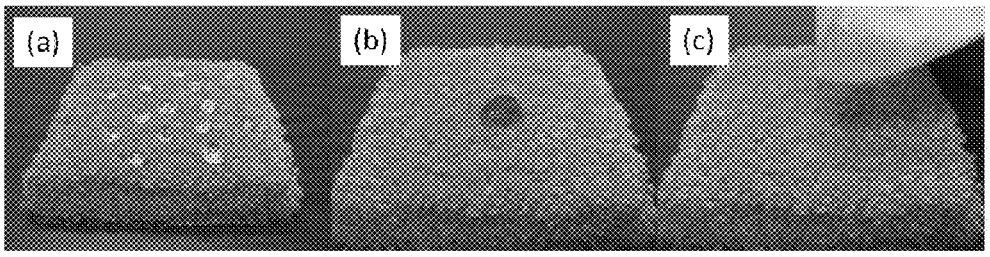
FIGS. 7*a*-7*c* are illustrative examples of (a) water droplets on carpet treated with a waterproof coating, (b) a colored water droplet on treated carpet and (c) treated carpet after wiping droplets with a napkin.

FIGS. 7*a*-7*c* are illustrative examples of (a) water droplets on carpet treated with a waterproof coating, (b) a colored water droplet on treated carpet, and (c) treated carpet after wiping droplets with a napkin As shown in FIGS. 7*a* and 7*b*, water droplets sit on top of the treated carpet and are not absorb by the carpet. FIG. 7*c* shows the droplet can be easily removed by a napkin without leaving any stain on the carpet.

The following describes the coating procedure of a natural whitewood block. A sol-gel solution comprising various ratios of tetraethyl orthosilicate, trimethoxy(propyl)silane, 3-glycidoxypropyltrimethoxysilane, water, HCl(aq) and ethanol was prepared by mixing the above chemicals at 60° C. for 12 hours. The wood block was then wetted completely by dipping or spraying the 10% of the above sol-gel solution (diluted with ethanol). After drying off the solvent at 25° C. under ventilation, the wood block was cured at 80° C. for 1 hour. After curing, the wood block was subjected to the trichloro(1H,1H,2H,2H-perfluorooctyl)silane vapor (the vapor was generated by heating the chemical on a 100° C. hotplate) in an enclosure for 15 minutes. The procedure was completed after removing the wood block from the enclosure.

Figures 8A, 8B:
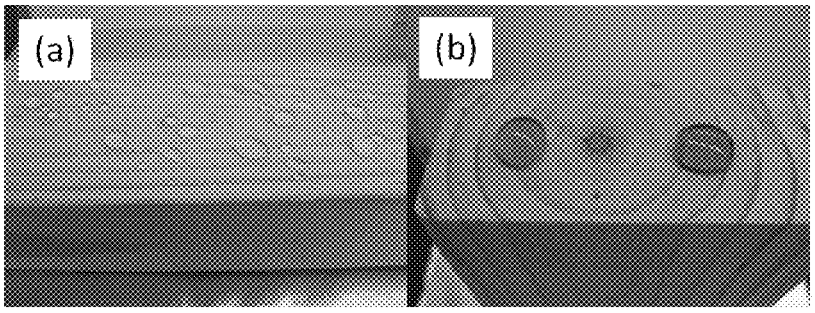
FIGS. 8*a*-8*b* are illustrative examples of (a) water droplets on wood treated with a waterproof coating and (b) colored water droplets on treated wood.

FIGS. 8*a*-8*b* are illustrative examples of (a) water droplets on wood treated with a waterproof coating and (b) colored water droplets on treated wood. The droplets are not absorbed by the wood and can easily roll off the surface without leaving any stain on the wood block once tilted.

The following describes the coating procedure of man-made construction materials (a concrete block and a kiln fired brick). A sol-gel solution comprising various ratios of tetraethyl orthosilicate, trimethoxy(propyl)silane, 3-glycidoxypropyltrimethoxysilane, water, HCl(aq) and methanol was prepared by mixing the above chemicals at 60° C. for 12 hours. The construction material was then wetted completely by dipping or spraying the 10% of the above sol-gel solution (diluted with ethanol). After drying off the solvent at 25° C. under ventilation, the weed block construction materials was cured at 60° C. for 12 hours. After curing, the construction material was subjected to the trichloro(1H,1H,2H,2H-perfluorooctyl)silane vapor (the vapor is generated by heating the chemical on a 100° C. hotplate) in an enclosure for 15 minutes. The procedure was completed after removing the construction material from the enclosure.

FIGS. 9*a*-9*d* are illustrative embodiment of (a) water on untreated concrete, (b) water on treated concrete, (c) water on untreated brick, and (d) water on treated brick. FIG. 9*a* shows water droplets on top of a regular concrete block. The droplets seeped into the block within seconds. However, once treated with waterproof coating (FIG. 9*b*), the droplets can no longer seep into the block and can roll off the surface easily once tilted. FIG. 9*c* shows water droplets on top of a regular kiln fired brick. The droplets seeped into the block within seconds. However, once treated with waterproof coating (FIG. 9*d*), the droplets can no longer seep into the brick and can roll off the surface easily once tilted.

The following describes the coating procedure of a tarpaulin made of a combination of polymer materials such as nylon and poly(ketone ethylene ether). A sol-gel solution comprising various ratios of tetraethyl orthosilicate, trimethoxy(propyl)silane, 3-glycidoxypropyltrimethoxysilane, water, HCl(aq) and methanol was prepared by mixing the above chemicals at 60° C. for 12 hours. The sol-gel solution may contain up to 15% of Titanium(IV) oxide nano/micro-particles as UV blockers. The tarpaulin was first treated with a primer solution to promote the adhesion of the sol-gel solution. After curing at 130° C. for 10 minutes, the tarpaulin was then wetted completely by dipping or doctor-blading of the above sol-gel solution (without dilution). After drying off the solvent at 25° C. under ventilation, the tarpaulin was cured at 130° C. for 10 minutes and the procedure was completed.

Figure 2A:
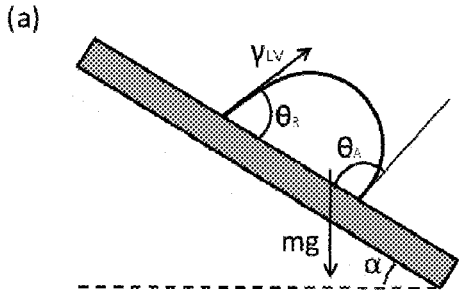
FIGS. 2*a*-2*b* illustrate (a) the parameters used to describe the sliding event of a water droplet on a substrate surface and (b) the method for the measurement of the critical water sliding (rolling) angle.
Figure 2B:
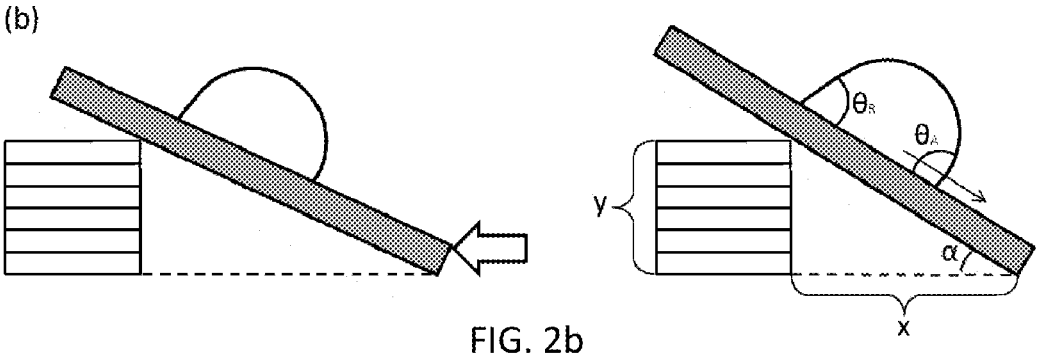

FIGS. 10*a*-10*b* are illustrative embodiments of (a) water on treated tarpaulin and (b) water on untreated pristine tarpaulin. While the water spreads out on the pristine tarpaulin sample and streaks the surface when it was tilted (FIG. 10*b*), the water coalesces on the treated tarpaulin and quickly slides off the surface without streaking (FIG. 10*a*). The critical water sliding angle (using method illustrated in FIG. 2*b*) of a 0.1 mL sessile drop of water is determined to be less than 15°.

The following describes the coating procedure of a cloth made of 100% cotton. The resulting coating exhibits properties not only superhydrophobic/waterproof, but also oleophilic. A sol-gel solution comprising various ratios of tetraethyl orthosilicate, trimethoxy(propyl)silane, 3-glycidoxypropyltrimethoxysilane, water, HCl(aq) and ethanol was prepared by mixing the above chemicals at 60° C. for 12 hours. The cotton cloth was then soaked in the 10% of the above sol-gel solution (diluted with ethanol) for 10 minutes. After drying off the solvent at 25° C. under ventilation, the cloth was cured at 80° C. for 1 hour. After curing, the cloth was subjected to the trichlorooctylsilane vapor (the vapor was generated by heating the chemical on a 100° C. hotplate) in an enclosure for 15 minutes. The procedure was completed after removing the cotton cloth from the enclosure.

Figures 11A, 11B:
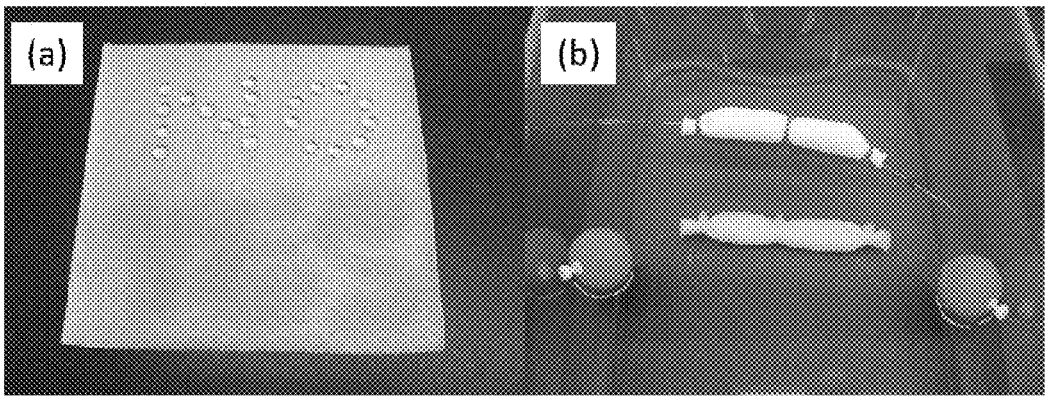
FIGS. 11*a*-11*b* are illustrative examples of (a) water and diesel droplets on cotton cloth treated with a waterproof/oleophilic coating and (b) an oil cleaning boom replica (made by glass fiber wrapped with cotton cloth) sinks to the bottom but the one treated with a waterproof/oleophilic coating stays dry and floats even without float anchors.

FIGS. 11*a*-11*b* are illustrative examples of (a) water droplets on cotton cloth treated with a waterproof/oleophilic coating. The coating repels water (illustrated with the word "NO") but soaks up diesel (illustrated with the word "YES"). (b) an oil cleaning boom replica (made by glass fiber wrapped with cotton cloth) sinks to the bottom even with float anchors. However, once treated with a waterproof/oleophilic coating, the boom stays dry and floats even without float anchors.

The follow examples describe examples that utilize an all solution process. The following describes the coating procedure of glass by dip-coating. A pre-cleaned glass with dimensions of 5" by 5" by ⅛" was activated by submerging the glass into a 10% (w/v) NaOH aqueous solution for 10 minutes. The glass surface was washed with water and methanol thoroughly. After drying, the glass was submerged into a 3% (v/v) trimethoxy(1H,1H,2H,2H-perfluorooctyl) silane in methanol prepared by mixing and heating the trichloro(1H,1H,2H,2H-perfluorooctyl)silane in methanol at 50° C. for 8 hours and then neutralized with KOH (may contain up to 15% (w/w) of water) until the pH reached above 7. After 10 minutes, the glass was removed from the solution and dried in an oven at 80° C. for 10 minutes. The glass was washed with methanol thoroughly and dried. The transmission of the resulting coating at the visible light range remains the same as the pristine glass surface (the difference in reflection is undetectable by common human eyes). The static contact angle of the resulting glass surface is 108±3° (average of 18 individual measurements). The critical angle for a 0.1 mL sessile drop of de-ionized water to sliding down the coated glass surface is ~16°.

The following describes the coating procedure of fabrics by dip-coating. Obtain a solution containment vessel that is impervious and non-reactive with alcohols (e.g. methyl-, ethyl- or isopropyl-alcohol) that may also dimensionally accommodate the fabric material to be treated as well as retain the corresponding requisite amount of solution. Ensure that the solution vessel is clean and free of any residue/debris. An appropriate amount of solution required per unit surface area of fabric is given by 0.50 mL/in$^2$ (this value varies slightly depending on the thickness and cross-weave density of the particular fabric material). Using this value, an appropriate volume of solution required is determined by approximating the surface area of the material to be treated and multiplying by 0.50 mL/in$^2$. When handling the sol-gel and the hydrophobic chemical solutions, always wear proper gloves (latex/nitrile), appropriate respirators and eye protections. A sol-gel solution comprised a various ratio of tetraethyl orthosilicate, trimethoxy(propyl)silane, 3-glycidoxypropyltrimethoxysilane, water, HCl(aq) and methanol was prepared by mixing the above chemicals at 60° C. for 12 hours. The sol-gel solutions were diluted to the appropriate concentration in a suitable solvent/solvents (e.g. methyl-alcohol, ethyl-alcohol, isopropyl-alcohol, denatured ethyl-alcohol, etc.). Once the appropriate volume of solution was added to the solution containment vessel, immerse the entire fabric sample in the solution bath such that the material was rendered saturated. If possible, avoid folding the fabric material when immersing in solution (i.e. if the solution containment vessel is smaller than the material it is to accommodate, slowly feeding the material through the bath). Once the fabric material was saturated, it was removed from the immersion bath and suspended over the solution containment vessel to allow any excess solution to drip off. Ensure that the area along the surface of the treated material from which the solution draining from is less than 7.0 cm from the surface of the solution below to avoid any splashing. Fabric materials should be suspended over the solution containment vessel until a continuous stream of solution flowing off the material was no longer observed. Continue to allow the sample to drip over the solution containment vessel until a drip-rate of 1 drop/s was attained. Subsequently, transfer the treated material to a well-ventilated area where it was suspended, via clipping, pinning or hanging, to air-dry for a minimum of 30 minutes at room conditions (25±10° C., 50% relative-humidity). It should be noted that fabric materials exhibiting an appreciably large portion of surface area not directly exposed to ambient air were anticipated to require longer drying times. Following air-drying, the treated sample was cured in a tumble-dryer on a delicate setting (or at a temperature not to exceed the recommended tumble dry condition for each specific fabric materials) for a minimum of 20 minutes. Tumble-drying for time intervals longer than 1 hour was not advised. Hydrophobic chemical solutions were comprised of either trichloro (1H,1H,2H,2H-perfluorooctyl)silane in anhydrous toluene, trichloro(3,3,3-trifluoropropyl)silane in anhydrous toluene, trimethoxy(1H,1H,2H,2H-perfluorooctyl)silane in methanol or trimethoxy(3,3,3-trifluoropropyl)silane in methanol. Trimethoxy(1H,1H,2H,2H-perfluorooctyl)silane in methanol or trimethoxy(3,3,3-trifluoropropyl)silane in methanol were prepared by mixing and heating either trichloro(1H,1H,2H,2H-perfluorooctyl)silane or trichloro(3,3,3-trifluoropropyl)silane in methanol at 50° C. for 8 hours and then the solutions were neutralized with KOH (may contain up to 15% (w/w) of water) until the pH reached above 7. The hydrophobic solutions were used directly or further diluted in an appropriate solvent (e.g. methyl-alcohol, ethyl-alcohol, isopropyl-alcohol, denatured ethyl alcohol, etc.). After tumble-drying, repeat the same dipping and drying procedure described herein with hydrophobic chemical solutions.

Cotton fabric samples treated with a 20% (v/v) sol-gel solution (comprised of a various ratio of tetraethyl ortho silicate, trimethoxy(propyl)silane, 3-glycidoxypropyltrimethoxysilane, water, HCl(aq) and methanol) in anhydrous methanol and a hydrophobic chemical solution (comprised of a 3% (v/v) trimethoxy(1H,1H,2H,2H-perfluorooctyl)silane in methanol) in accordance with the dip-coating procedure described above were subjected to a Water Repellency: Spray Test (AATCC Test Method 22-2005) scored an average of 93 points per test. Polyester fabric samples treated with a 20% (v/v) sol-gel solution in anhydrous methanol and a hydrophobic chemical solution (comprised of a 3% (v/v) trimethoxy(1H,1H,2H,2H-perfluorooctyl)silane in methanol) in accordance with the dip-coating procedure described above were subjected to liquid-repellency test (AATCC Test Method 193-2007: Aqueous Liquid Repellency—Water/Alcohol Solution Resistance Test) scoring a grade between 4 and 8. Nylon (80% w/w)/Polyester (20% w/w) blend microfiber samples were treated with a 20% (v/v) sol-gel solution in anhydrous methanol and a hydrophobic chemical solution (comprised of a 3% (v/v) trimethoxy(1H,1H,2H,2H-perfluorooctyl)silane in methanol) in accordance with the dip-coating procedure described above. All microfiber samples maintained a grading of A in surface hydrophobicity per aqueous liquid-repellency test with pure water (AATCC Test Method 193-2007: Aqueous Liquid Repellency—Water/Alcohol Solution Resistance Test) even after 24 h. Microfiber samples were subjected to liquid-repellency test (AATCC Test Method 193-2007: Aqueous Liquid Repellency—Water/Alcohol Solution Resistance Test) scoring a grade between 4 and 8. No staining of the microfiber fabric was observed even prior to the stain-removal process. Treated microfiber samples have maintained their hydrophobic properties (aqueous liquid-repellency test with pure water maintaining a grading of A for at least 1 hour) even after 15 wash cycles (following the AATCC Standardization of Home Laundry Test Conditions: washing procedure—cold water, delicate; drying procedures—tumble, delicate, exhaust temperature <60° C.).

The following describes the coating procedure of fabrics by spray-coating. When handling the sol-gel and the hydrophobic chemical solutions, Always wear proper gloves (latex/nitrile), appropriate respirators and eye protections. Make sure to apply solutions in a well-ventilated area. While in a ventilated area, make sure to be located up-wind and that no other individuals and/or animals are down-wind from the region where application of solutions take place. If possible, it is recommended to apply solutions outdoors when the relative humidity is low (<70% relative-humidity). Prepare the solutions to be used by diluting it to the appropriate concentration in suitable solvent(s) (e.g. methyl-alcohol, ethyl-alcohol, isopropyl-alcohol, denatured ethyl-alcohol, etc.). Once the solution has been prepared, fill an approved pneumatic pump hand-held sprayer that is safely capable of dispensing 6.5 mL/s of solutions in a conic shape (in-between typical mist and jet spray settings). Remove any extraneous materials that are not to be treated with solutions away from the immediate region where spraying takes place. Position the material to be treated with solutions in such a way that the application bottle may be held as close to upright as possible. When ready, first apply sol-gel solution with the nozzle 3" (8 cm) from the fabric surface. Spray with a slow continuous side-to-side sweeping motion of the wrist with partial overlap starting from the top of the item of fabric to be treated towards the bottom (excess liquid will run down the material to promote even application). Continue to spray in the manner described above until the material is thoroughly soaked, but not dripping. For most fabrics, a sol-gel solution pick-up of 200% (w/w) is recommended. Be prepared for possible dripping by clearing the area beneath the item to be treated. Once the entire surface of the material has been treated, allow the material to dry at room temperature conditions (25±10° C., 50% relative-humidity) for a minimum of 2 hours. If time is an issue, allow the sample to dry at room temperature for a minimum of 30 minutes and finish drying in a tumble-dryer on a delicate setting (or at a temperature not to exceed the recommended tumble dry condition for each specific fabric materials) for an additional 20 minutes (make sure the material to be dried is not excessively wet before inserting into the dryer). This promotes and expedites the cross-linking process. Do not touch the material while it is still wet as this could affect the treatment process. After drying, repeat the same spraying and drying procedure described herein with hydrophobic chemical solutions.

Cotton fabric samples (with a 7"×7" effective cross-sectional area) were treated with a 20% (v/v) sol-gel solution (comprised of a various ratio of tetraethyl orthosilicate, trimethoxy(propyl)silane, 3-glycidoxypropyltrimethoxysilane, water, HCl(aq) and methanol) in anhydrous methanol and a hydrophobic chemical solution (comprised of a 3% (v/v) trimethoxy(1H,1H,2H,2H-perfluorooctyl)silane in methanol) in accordance with the spray-coating procedure described above. Each sample was hanged, one-by-one, by two corners using clothespins suspended from a taut wire. Each sample was sprayed for 3.5 seconds with partial overlap covering the entire surface area of one side of the sample. The pneumatic pump hand-held sprayer used outputted a volume of 6.5 mL/s. A total of 22.6 mL of the respective dilution of sol-gel solution in anhydrous methanol was sprayed onto each sample. The samples were sprayed using the mist setting (at the borderline of mist/jet) with the nozzle maintained at a distance of 3" from the surface of each cotton sample. Samples were sprayed in a well-ventilated area. After allowing samples to air-dry for 30 minutes, they were immediately tumble-dried for an additional 20 minutes with the tumble-dryer set to delicate mode. Once the samples were dried, the process was repeated for the spraying of the hydrophobic chemical solution. After tumble-drying, samples following the curing process exhibited good surface hydrophobicity (aqueous liquid-repellency test with pure water maintaining a grading of A for at least 3 hours). It is concluded that curing in the tumble-dryer is an important step that should be included in the application directions in order to achieve an optimal coating in a comparatively short time interval.

The following describes the coating procedure of carpets by dip-coating. Samples of nylon-6 carpets were treated via the dip-coating method described above using a 20% (v/v) sol-gel solution (comprised of a various ratio of tetraethyl orthosilicate, trimethoxy(propyl)silane, 3-glycidoxypropyltrimethoxysilane, water, HCl(aq) and methanol) in anhydrous methanol followed by a treatment with the hydrophobic chemical solutions (comprised of either a 3% (v/v) trimethoxy(1H,1H,2H,2H-perfluorooctyl)silane in methanol or a 3% (v/v) trimethoxy(3,3,3-trifluoropropyl)silane in methanol) with a slight modifications described herein. Samples were pre-conditioned by blowing medium pressure air at the samples to remove extraneous loose-fibers. Each sample was individually weighed, then treated with the respective sol-gel solution. The coating vessel used was a glass petri dish (5" in diameter). Each sample was immersed, in 200 mL of 20% (v/v) sol-gel solution in anhydrous methanol, for 30 seconds with the underside facing downwards. Following 30 seconds, the sample was removed from the solution bath, partially drained, and then re-immersed for an additional 30 seconds with the topside facing downwards. After 30 seconds, the sample was drained of excess solution to a pick-up of 86%. Once the excess solution was drained, each sample was placed on a drying rack. Samples were allowed to air-dry at room conditions (25±10° C., 50% relative-humidity) for 80 minutes and subsequently cured in an oven at 60° C. for 30 minutes. The above procedure was repeated for the hydrophobic chemical solution treatment process using either a 3% (v/v) trimethoxy(1H,1H,2H,2H-perfluorooctyl)silane in methanol or a 3% (v/v) trimethoxy (3,3,3-trifluoropropyl)silane in methanol. The same curing/drying procedure described above was used to dry/cure all samples treated with above solutions. After curing in the oven, samples were allowed to air-dry for an additional 1 hour to ensure that all critical reactions were completed. After treatment, the texture of all samples remained plush/soft. All samples were subjected to a 1-hour stain test using 1 mL of Powerade (red) and instant coffee (1 pack/100 mL at 55° C.) (Ford Laboratory Test Method BN 112-08: Soiling & Cleanability Test for Interior Trim Materials). The hydrophobicity of samples ranged according to the hydrophobic chemical presented (e.g. samples treated with trimethoxy(1H,1H,2H,2H-perfluorooctyl)silane solution exhibited a higher degree of hydrophobicity than samples treated with trimethoxy(3,3,3-trifluoropropyl)silane solution at the same pick-up). After 1 hour, all samples treated with solution trimethoxy(3,3,3-trifluoropropyl)silane solution exhibited a hydrophobicity grading of B while all samples treated with trimethoxy(1H,1H,2H,2H-perfluorooctyl)silane solution exhibited a hydrophobicity grading of A per AATCC aqueous liquid-repellency test. All samples treated with trimethoxy(1H,1H,2H,2H-perfluorooctyl)silane solution were subjected to liquid-repellency test (AATCC Test Method 193-2007: Aqueous Liquid Repellency—Water/Alcohol Solution Resistance Test) scoring a grade between 4 and 8. Stained samples were washed per stain resistance test (AATCC Test Method 175-2008: Stain Resistance—Pile Floor Coverings). All samples continued to exhibit minor staining but appreciably better than a pristine sample.

The following describes the coating procedure of carpets by carpet-cleaner apparatus. Studies on the viability of using a carpet-cleaner apparatus employing the use of sol-gel and hydrophobic chemicals in organic solvents (i.e. carpet-cleaners equipped with liquid containment reservoirs that clean carpets by depositing a cleaning solution into the carpet, spin-scrubbing the solution into the carpet and vacuuming the resulting soiled cleaning solution back into a second onboard liquid retention reservoir) has demonstrated overall good results. Methanol-based solutions were cycled through a carpet-cleaner apparatus with no apparent signs of hardware failure/stress. Solutions poured into the clean solution reservoir were dispensed from the apparatus into the carpet where an acceptable degree of wetting of the carpet was observed. The solution was vigorously scrubbed into the tuffs of the carpet and subsequently vacuumed back into the carpet-cleaner apparatus (dirty solution reservoir). A sufficient volume of solution was retained by the carpet. Therefore, a deposition procedure embodied by the application of an appropriate solution listed in the previous section to a carpet substrate via an appropriate carpet-cleaner apparatus can be implemented: A specimen of nylon-6 carpet of medium fiber density with fibers 3-4 mm in length with dimensions 36.0"×42.5" was stapled at all four corners to a larger floor mat beneath serving as a testing platform. The effective surface area of the carpet specimen (1530 $in^2$) was equally partitioned into three sections such that each of the three sections corresponds to a particular treatment method. The three sections were used to compare the performance of a 10% (v/v) sol-gel solution (comprised of a various ratio of tetraethyl orthosilicate, trimethoxy(propyl)silane, 3-glycidoxypropyltrimethoxysilane, water, HCl(aq) and methanol) in anhydrous methanol followed by a 3% (v/v) hydrophobic chemical solution (comprised of a trimethoxy(3,3,3,-trifluoropropyl)silane in methanol) treatment and a 20% (v/v) sol-gel solution in anhydrous methanol followed by a 3% (v/v) hydrophobic chemical solution treatment against a pristine section. No pre-treatment was implemented in the present study. 300 mL of a 10% (v/v) sol-gel solution in anhydrous methanol were added to the clean solution reservoir of a Hoover® Turbo Scrub carpet washer. Ten back-and-forth passes (i.e. ten forward passes interspaced with ten backward passes) were made in partial accordance with the user directions provided by the carpet washer manufacturer at a speed of 6 in/s. After ten back-and-forth passes, only 10 mL of solution remained in the clean solution reservoir, 70 mL of solution were recovered in the dirty solution reservoir, and 24 mL of unused solution was retained in the plastic tubing of the carpet washer plumbing system. The amount in the tubing was approximated by determining the volume of a cylinder of radius 0.5 cm and 30.5 cm in height. The carpet specimen was allowed to air-dry for 2 hour at room conditions (25±10° C., 50% relative-humidity) and cured for an additional 2 hour using two hot-air blowers operating at maximum capacity positioned 1 foot from the carpet edge and oriented at a slight angle to optimize the surface area covered by each blower. Analogously, the deposition procedure aforementioned was repeated using the hydrophobic chemical solution (300 mL), where 80 mL of solution was recovered by the dirty solution reservoir and 10 mL of unused solution remained in the clean solution reservoir. It should be noted that a rinse-cycle using 200 mL of methanol was conducted in-between the applications. Following the deposition of the hydrophobic chemical solution, the carpet was allowed to dry/cure under hot-air (two hot-air blowers) for 14 hours (overnight).

The following describes the coating procedure of threads by dip-coating. Samples of thread made by a variety of materials (e.g. cotton, nylon or polyester) 20 m in length were prepared on metal spools. The initial mass of the pristine bundle/spool of thread was measured. Each samples of thread, one-by-one, was installed into the coating apparatus by unraveling the bundle/spool into to loading spool, leaving the appropriate length of thread available for use in priming the coating apparatus. The solution containment vessel used was 30 cm in length and resembled a solution trough through which the thread must pass through while submerged in solution in order to fill a collection spool at the other end of the apparatus (opposite the loading spool). The reservoir was filled with sol-gel solutions (comprised of a various ratio of tetraethyl orthosilicate, trimethoxy(propyl)silane, 3-glycidoxypropyltrimethoxysilane, water, HCl(aq) and methanol) at four different concentrations (10, 20, 30, and 40% v/v) all in anhydrous methanol until the two rollers inside the solution containment vessel (trough) were entirely submerged. The time required for the sample of thread to pass through the apparatus (i.e. from the loading spool to the spindle) was recorded and used to calculate the rate of thread propagation (2.5 m/s), which corresponded to a 30% pick-up (w/w) of diluted sol-gel solution. Immediately after the collection spool was filled and the motor was turned off, the thread sample was removed from the collection spool and weighed to determine the wet mass. This was used to determine the pick-up mass. Once the wet mass had been measured, the samples were allowed to dry/cure thoroughly at room conditions (25±10° C., 50% relative-humidity) for 30 minutes followed by an additional 15 minutes in a ventilated oven maintained at a temperature of 140° C. Once all samples were entirely cured, the process was repeated with a hydrophobic chemical solution (comprised of a 3% (v/v) trimethoxy(3,3,3-trifluoropropyl)silane in methanol). Samples were prepared by tightly wrapping treated thread samples around a cardboard spool. The thread was wrapped into a mono-layer of tightly packed thread. Following each trial, samples were subjected to a hydrophobicity test: where 1 mL of pure water was placed on top of each sample using a syringe. The time at which the entirety of the 1 mL deposited on each sample began to shift from a grade A to a grade D in accordance with the aqueous liquid-repellency test (AATCC Test Method 193-2007: Aqueous Liquid Repellency—Water/Alcohol Solution Resistance Test) is referred to as the time of failure. On average, a pristine sample fails at less than 25 seconds. Samples treated with a 10, 20, 30 or 40% (v/v) sol-gel solution in anhydrous methanol maintained a grade A for 1, 4, 2 or >4 hours, respectively.

The following describes the coating procedure of wood (cedar fence board) by soaking with the sol-gel solution. The wood was cut into samples with dimensions of 3" by 3" by ½". For an experiment, care was taken to use the samples from the same board, as there might be differences in porosity, density of different planks. A sol-gel solution comprised a various ratio of tetraethyl orthosilicate, trimethoxy(propyl)silane, 3-glycidoxypropyltrimethoxysilane, water, HCl(aq) and methanol was prepared by mixing the above chemicals at 60° C. for 12 hours. A 50 ml of such sol-gel solution was poured onto a petri dish and the sample was then soaked, 30 seconds on each side. The weight of the sample was measured before and after solution treatment. An average of 9% increase in weight was observed immediately after soaking. The wood sample was dried at room conditions (25±10° C., 50% relative-humidity) for 30 minutes and after that cured in the over at 60° C. for 4 hours. The oven was ventilated and was equipped with a small pump which provided a small but steady flow of air. This prevented the buildup of moisture in the oven. A consistent base for comparison among the different test samples was necessary, as the properties of wood change in response to the environmental equilibrium moisture content, and any comparison of these properties must take moisture content into account. In this effect, the treated samples as well as a control pristine sample, were left overnight (18 hours) in ambient conditions (25±10° C., 50% relative-humidity). This brought the wood samples at equilibrium with the atmospheric temperature as well as moisture content. The weight of each sample was recorded before testing. For testing, the wood was immersed 1 cm below the water-line in a water bath maintained at room temperature (20±5° C.). After set intervals of time, the specimens were removed from the water and weighed. The percent weight change from the original weight represented the water absorption. This water immersion test was done for 2 hours on each sample. External weights were put on each sample to ensure immersion. The results showed that the water absorption values of all treated samples were considerably low compared with control sample. The wood samples treated with the sol-gel solution showed a 62% decrease in water absorption when compared to the pristine control sample. In addition, the time required for the wood samples to absorb 20% of its weight in water was calculated from the data obtained. It took 2-2.5 hours for the pristine sample and 10 hours for treated sample. In other words, the coating reduced the water absorption rate of cedar wood by 4-5 times.

The following describes the coating procedure of wood (cedar fence board) by soaking with the sol-gel and the hydrophobic chemical solution. The wood was cut into samples with dimensions of 3" by 3" by ½". For an experiment, care was taken to use the samples from the same board, as there might be differences in porosity, density of different planks. A sol-gel solution comprised a various ratio of tetraethyl orthosilicate, trimethoxy(propyl)silane, 3-glycidoxypropyltrimethoxysilane, water, HCl(aq) and methanol was prepared by mixing the above chemicals at 60° C. for 12 hours. A 50 ml of such sol-gel solution was poured onto a petri dish and the sample was then soaked, 30 seconds on each side. The weight of the sample was measured before and after solution treatment. An average of 9% increase in weight was observed immediately after soaking. The wood sample was cured in the oven at 60° C. for 1 hour. Hydrophobic chemical solutions comprised of either trimethoxy(1H,1H,2H,2H-perfluorooctyl)silane in methanol or trimethoxy(3,3,3-trifluoropropyl)silane in methanol were prepared by mixing and heating either trichloro(1H,1H,2H,2H-perfluorooctyl)silane or trichloro(3,3,3-trifluoropropyl)silane in methanol at 50° C. for 8 hours and then the solutions were neutralized with KOH (may contain up to 15% (w/w) of water) until the pH reached above 7. The hydrophobic chemical solutions were then poured onto a petri dish and the sample was then soaked, 30 seconds on each side again. The samples were then cured at 60° C. for 18 hours. Contact angle measurement was done by drop shape method. The contact angles were measured using a horizontally placed microscope with camera which provides us a live video image of the sample. The microscope is calibrated, enabling us to accurately measure the contact angle. A drop of water was carefully deposited on the sample and then, the measurements were taken when making sure the sessile drop was not disturbed. The contact angles for the samples treated with hydrophobic chemical solutions made of trimethoxy(1H,1H,2H,2H-perfluorooctyl)silane in methanol or trimethoxy(3,3,3-trifluoropropyl)silane in methanol were 127° and 102°, respectively. The coated wood samples were test under UVC lamps for over 90 hours to simulate the long-term UV damage to the wood samples due to sunlight exposure. The samples were exposed 6" under an array of 5 Mercury lamps from Atlantic-UV (STER-L-RAY Germicidal Lamp, UV output 5.7 W, with the energy distribution: 254 nm-100%; 313 nm-1%; 365 nm-1%; 405 nm-1%; 436 nm-6% and 546 nm-4%). The samples did not show any physical change after the UVC testing—no sign of cracking, peeling or bubbling was observed.

The following describes the coating procedure of various species of wood by aerosol spraying. Wood species included here were particle board/wood composite, whitewood and western red cedar. A sol-gel solution comprised a various ratio of tetraethyl orthosilicate, trimethoxy(propyl)silane, 3-glycidoxypropyltrimethoxysilane, water, HCl(aq) and methanol was prepared by mixing the above chemicals at 60° C. for 12 hours. The samples of all species of wood were cut into specific dimensions (usually 5.5" by 5.5" by ⅝") that were kept constant throughout the trials. Samples were initially weighed and then placed onto rack where the samples were oriented at an angle of 5 degrees with the horizontal. The sol-gel solution was filled into an aerosol container and sprayed onto every side of the samples for 3 seconds per face (large area of the sample) and 1-2 seconds onto the sides (small area of the sample). Samples were then left in a room that was kept constant at 25±5° C. for 4 hours and weighed. After 20 minutes, samples were weighed again to make sure that the evaporation has slowed to <0.5 mg/minute. Certain samples (a certain number of samples from each species tested) were chosen beforehand to be sprayed with the sol-gel solution again. Same spraying technique as mentioned above was used for the second time. Overall the average sol-gel retention was 13.5%. After all samples have dried and their weights recorded, some samples were sprayed with a hydrophobic chemical solution comprised of a 3% (v/v) trichloro(3,3,3-trifluoropropyl)silane in anhydrous toluene using the same style aerosol sprayers. Samples were then left in a room that was kept constant at 25±5° C. for 2 hours and weighed. After 20 minutes, samples were weighed again to make sure that the evaporation has slowed to <0.5 mg/minute. A simulated rain test procedure was carried out using a showerhead hanging 1 foot above a rack which oriented the wood sample at a 45 degree angle. Before carrying out the experiment, the initial weight of the wood sample was measured. 1 L of water at 25±5° C. was poured into a container connected to the showerhead and allowed to flow through the showerhead using gravity at an average flow rate of 26 L/hour. After all of the water had passed through the showerhead and onto the sample, excess water on top of the sample was wiped away using a paper towel and the sample was weighed and the difference was recorded. Immediately after the simulated rain test procedure, a test procedure was carried out to measure the moisture evaporating rate. Samples were left in a room at 25±5° C., 50% relative-humidity and were weighed periodically until the water absorbed by the rain test fully evaporated. The total amount of time needed for the water absorbed to be fully evaporated was recorded and compared. All samples applied with both the sol-gel procedure and the hydrophobic chemical procedure were tested against the control group of untreated samples: coated particle board samples absorbed 71% less water and the decrease in absorption allowed for evaporation of coated particle board samples to be 70% faster; coated whitewood samples absorbed 85% less water and the decrease in absorption allowed for evaporation of coated whitewood samples to be 74% faster; coated western red cedar samples absorbed 89% less water and decrease in absorption allowed for evaporation of coated western red cedar samples to be 76% faster.

The following describes the coating procedure of various species of wood by a compressed air spray gun. Wood species included here were particle board/wood composite, whitewood and western red cedar. A sol-gel solution comprised a various ratio of tetraethyl orthosilicate, trimethoxy (propyl)silane, 3-glycidoxypropyltrimethoxysilane, water, HCl(aq) and methanol was prepared by mixing the above chemicals at 60° C. for 12 hours. The samples of all species of wood were cut into specific dimensions (usually 5.5" by 5.5" by ⅝") that were kept constant throughout the trials. Samples were initially weighed and then placed onto rack where the samples were oriented at an angle of 5 degrees with the horizontal. A compressor was set at 30 PSI and the air spray gun was adjusted so that the flow rate was varied until it was found that 7.2 L/hour was optimal. The sol-gel solution was filled into the spray gun and sprayed onto every side of the samples for 3 seconds per face (large area of the sample) and 1-2 seconds onto the sides (small area of the sample). Samples were then left in a room that was kept constant at 25±5° C. for 4 hours and weighed. After 20 minutes, samples were weighed again to make sure that the evaporation has slowed to <0.5 mg/minute. Certain samples were chosen beforehand to be sprayed with the sol-gel solution again. Same spraying technique as mentioned above was used for the second time. After all samples have dried and their weights recorded, some samples were sprayed with a hydrophobic chemical solution comprised of a 3% (v/v) trimethoxy(3,3,3-trifluoropropyl)silane in methanol using the same compressed air spray gun. Samples were then left in a room that was kept constant at 25±5° C. for 2 hours and weighed. After 20 minutes, samples were weighed again to make sure that the evaporation has slowed to <0.5 mg/minute. A simulated rain test procedure described above was carried out and all results were compared to pristine/untreated samples tested under equivalent conditions. Samples applied with only the sol-gel procedure absorbed 63% less water than pristine samples. Samples applied with both the sol-gel procedure and the hydrophobic chemical procedure absorbed 77% less water than pristine samples. Results were consistent with previous results using the aerosol spray deposition process.

The following describes the coating procedure of various species of wood by a hand-pump garden-style sprayer. Because the application of the sol-gel solution and the hydrophobic chemical solution using this sprayer is similar to the application of those using the compressed air spray gun, the focus of this section was to determine the capabilities of the garden-style hand-pump sprayer in terms of flow rates. Various nozzle were tested under the same conditions and each nozzle was tested for different pressures in the sprayer determined by the number of times the sprayer was pumped prior to spraying. 2 L was used as the set volume for calculating the flow rate. Number of times the sprayer was pumped ranged from 20 to 40 times with 5-pump interval. The flow rate using the plastic nozzles was determined to be 12 L/hour for 20 pumps. Since this was already over our desired flow rate of 7 L/hour, the number of pumps remained constant at 20 for the remainder of the experiment. It was determined that the brass nozzle allowed the sprayer to dispense the solution at a rate of 5.7 L/hour which was the desired for the applications of both solutions.

Embodiments described herein are included to demonstrate particular aspects of the present disclosure. It should be appreciated by those of skill in the art that the embodiments described herein merely represent exemplary embodiments of the disclosure. Those of ordinary skill in the art should, in light of the present disclosure, appreciate that many changes can be made in the specific embodiments described and still obtain a like or similar result without departing from the spirit and scope of the present disclosure. From the foregoing description, one of ordinary skill in the art can easily ascertain the essential characteristics of this disclosure, and without departing from the spirit and scope thereof, can make various changes and modifications to adapt the disclosure to various usages and conditions. The embodiments described hereinabove are meant to be illustrative only and should not be taken as limiting of the scope of the disclosure.

What is claimed is:

1. A method of forming a self-cleaning coating on a substrate comprising the steps of:

selecting a substrate;

treating the substrate with a sol-gel to coat the substrate, wherein the sol-gel comprises a metal oxide precursor, silanol, silane, or a derivative thereof;

curing the substrate at a temperature equal to or between 25-200° C. after the treating step to form a cured coating, wherein the sol-gel forms an interpenetration polymer network that provides a microscopic or nanoscopic topology on a surface of the substrate, and the cured coating is flexible; and coating the surface of the substrate with at least one hydrophobic chemical agent after the treating step, wherein the at least one hydrophobic chemical agent is applied using vapor deposition performed in an enclosure providing a controlled environment that surrounds the substrate, a final sol-gel and hydrophobic coating remain flexible, and the at least one hydrophobic chemical agent used has a formula of fluoroalkylsilane $[CF_3(CF_2)_a(CH_2)_b]_cSiX_{4-c}$ (where a=0-20, b=0-10, c=1-3, and X=Cl, Br, or I).

2. The method of claim 1, wherein the sol-gel comprises a material with a formula:

$M(OR)_{4-x}R'_x$, where M=Si, Al, In, Sn or Ti; x=0 to 3, and

R and R' can be the same or different and comprises hydrogen, a substituted or unsubstituted alkyl, a substituted or unsubstituted alkenyl, a substituted or unsubstituted alkynyl, a substituted or unsubstituted aryl, a substituted or unsubstituted epoxy, or a substituted or unsubstituted amine.

3. The method of claim 1, wherein the microscopic or nanoscopic topology on the substrate varies in depth from equal to or between 300 μm to 5 nm.

4. The method of claim 1, further comprising keeping the controlled environment at a set temperature equal to or between 25-300° C.

5. The method of claim 4, wherein the controlled environment is kept at a set pressure equal to or between 0.001-10 atm.

6. The method of claim 1, wherein the sol-gel or the at least one hydrophobic chemical agent renders the substrate oleophilic.

7. The method of claim 1, wherein an additive is added to the sol-gel, and the additive includes a material that provides UV absorbing or blocking, anti-reflective, fire-retardant, conducting, oleophilic, pigmentation, or anti-microbial benefits.

8. The method of claim 1, wherein the substrate is a metal, metal oxide, organic/inorganic composite containing a metal or metal oxide and plastic with silicon dioxide or metal oxides layer, natural polymer, cellulose or protein, man-made polymer, polyester, polyamide, polyether and copolymer, poly(ethylene terephthalate) and poly(ketone ethylene ether), inorganic material, glass, clay, ceramic, woven fiber, cotton, wool, cloth, polymer tarpaulin, non-woven fibers, paper, wood, natural inorganic, man-made inorganic, stone, or concrete brick.

9. The method of claim 1, wherein the fluoroalkylsilane is selected from the group consisting of trichloro(3,3,3-trifluoropropyl)silane, trichloro(1H,1H,2H,2H-perfluorooctyl)silane, trichloro(3,3,4,4,5,5,6,6,7,7,8,8,8-tridecafluorooctyl) silane, trichloro(1H,1H,2H,2H-perfluorodecyl)silane, or trichloro(1H,1H,2H,2H-perfluorododecyl)silane.

10. A method of forming a self-cleaning coating on a substrate with an all solution process comprising the steps of:

selecting a substrate;

treating the substrate with a sol-gel solution to coat the substrate, wherein the sol-gel comprises a metal oxide precursor, silanol, silane, or a derivative thereof;

curing the substrate at a temperature equal to or between 25-200° C. after the sol-gel solution treatment to form a cured coating; and coating a surface of the substrate with at least one hydrophobic chemical agent solution, wherein the sol-gel solution or the at least one hydrophobic chemical agent solution forms an interpenetration polymer network that provides a microscopic or nanoscopic topology on the surface of the substrate, the cured coating and a final sol-gel and hydrophobic coating remain flexible, and the at least one hydrophobic chemical agent used has a formula of fluoroalkylsilane $[CF_3(CF_2)_a(CH_2)_b]_cSiX_{4-c}$ (where a=0-20, b=0-10, c=1-3, and X=Cl, Br, or I).

11. The method of claim 10, wherein the sol-gel comprises a material with a formula:

$M(OR)_{4-x}R'_x$, where M=Si, Al, In, Sn or Ti; x=0 to 3, and

R and R' can be the same or different and comprises hydrogen, a substituted or unsubstituted alkyl, a substituted or unsubstituted alkenyl, a substituted or unsubstituted alkynyl, a substituted or unsubstituted aryl, a substituted or unsubstituted epoxy, or a substituted or unsubstituted amine.

12. The method of claim 10, wherein the microscopic or nanoscopic topology on the substrate varies in depth from equal to or between 300 μm to 5 nm.

13. The method of claim 10, wherein the sol-gel or the at least one hydrophobic chemical agent renders the substrate oleophilic.

14. The method of claim 10, wherein an additive is added to the sol-gel, and the additive includes a material that provides UV absorbing or blocking, anti-reflective, fire-retardant, conducting, oleophilic, pigmentation, or anti-microbial benefits.

15. The method of claim 10, wherein the substrate is a metal, metal oxide, organic/inorganic composite containing a metal or metal oxide and plastic with silicon dioxide or metal oxides layer, natural polymer, cellulose or protein, man-made polymer, polyester, polyamide, polyether and copolymer, poly(ethylene terephthalate) and poly(ketone ethylene ether), inorganic material, glass, clay, ceramic, woven fiber, cotton, wool, cloth, polymer tarpaulin, non-woven fibers, paper, wood, natural inorganic, man-made inorganic, stone, or concrete brick.

16. The method of claim 10, wherein the fluoroalkylsilane is selected from the group consisting of trichloro(3,3,3-trifluoropropyl)silane, trichloro(1H,1H,2H,2H-perfluorooctyl)silane, trichloro(3,3,4,4,5,5,6,6,7,7,8,8,8-tridecafluorooctyl)silane, trichloro(1H,1H,2H,2H-perfluorodecyl) silane, or trichloro(1H,1H,2H,2H-perfluorododecyl)silane.

17. A method of forming a self-cleaning coating on a substrate comprising the steps of:

selecting a substrate;

treating the substrate with a sol-gel to coat the substrate, wherein the sol-gel comprises a metal oxide precursor, silanol, silane, or a derivative thereof;

curing the substrate after the treating step to form a cured coating; and coating the surface of the substrate with at least one hydrophobic chemical agent, wherein the coating step is performed in an enclosure providing a controlled environment that surrounds the substrate, wherein the sol-gel or at least one hydrophobic chemical agent forms an interpenetration polymer network that provides a microscopic or nanoscopic topology on the surface of the substrate, the cured coating and a final sol-gel and hydrophobic coating remain flexible, and the at least one hydrophobic chemical agent used has a formula of fluoroalkylsilane $[CF_3(CF_2)_a(CH_2)_b]_cSiX_{4-x}$ (where a=0-20, b=0-10, c=1-3, and X=Cl, Br, or I).

18. The method of claim 17, further comprising keeping the controlled environment at a set temperature equal to or between 25-300° C.

19. The method of claim 18, wherein the controlled environment is kept at a set pressure equal to or between 0.001-10 atm.

20. The method of claim 17, wherein the sol-gel comprises a material with a formula:

$$M(OR)_{4-x}R'_x,$$

where M=Si, Al, In, Sn or Ti; x=0 to 3, and

R and R' can be the same or different and comprises hydrogen, a substituted or unsubstituted alkyl, a substituted or unsubstituted alkenyl, a substituted or unsubstituted alkynyl, a substituted or unsubstituted aryl, a substituted or unsubstituted epoxy, or a substituted or unsubstituted amine.

* * * * *